US007658268B2

(12) United States Patent
Kinpara et al.

(10) Patent No.: US 7,658,268 B2
(45) Date of Patent: Feb. 9, 2010

(54) CONTROL DEVICE WITHOUT A SPEED SENSOR FOR CONTROLLING SPEED OF A ROTATING MACHINE DRIVING AN ELEVATOR

(75) Inventors: Yoshihiko Kinpara, Tokyo (JP); Masahiro Fukuta, Tokyo (JP)

(73) Assignees: Mitsubishi Electric Corporation, Tokyo (JP); Mitsubishi Electric Building Techno-Service Co., Ltd., Tokyo (JP)

( * ) Notice: Subject to any disclaimer, the term of this patent is extended or adjusted under 35 U.S.C. 154(b) by 452 days.

(21) Appl. No.: 11/575,509

(22) PCT Filed: Oct. 28, 2004

(86) PCT No.: PCT/JP2004/016036

§ 371 (c)(1),
(2), (4) Date: Mar. 19, 2007

(87) PCT Pub. No.: WO2006/046295

PCT Pub. Date: May 4, 2006

(65) Prior Publication Data

US 2007/0227828 A1 Oct. 4, 2007

(51) Int. Cl.
*B66B 1/28* (2006.01)

(52) U.S. Cl. ..... 187/293; 187/393

(58) Field of Classification Search ..... 187/247, 187/278, 293–297, 391–393; 318/268, 270, 318/276, 802–812, 269, 273, 274, 362, 375, 318/376, 432
See application file for complete search history.

(56) References Cited

U.S. PATENT DOCUMENTS 4,982,816 A * 1/1991 Doi et al. ..... 187/296

(Continued)

FOREIGN PATENT DOCUMENTS

EP 607 646 7/1994

(Continued)

OTHER PUBLICATIONS

Kinpara, Yoshihiko et al.; "Stability Analysis of Adaptive Flux Observer of Induction Motor in Regenerative Operation", *Inst. Electrical Engineers of Japan-Industry Applications Society*, I-55 (1998).

*Primary Examiner*—Jonathan Salata
(74) *Attorney, Agent, or Firm*—Leydig, Voit & Mayer, Ltd.

(57) ABSTRACT

A control device for a rotating machine driving an elevator suppresses increases in the moving time of the elevator while securing control and stability in accordance with moving direction and load of a car of the elevator. A control device for controlling speed of the rotating machine without using a speed sensor includes a speed command signal generator for generating a rotational speed command for the rotating machine; and a speed sensor-less controller for controlling a voltage applied to the rotating machine without using a speed sensor, based on the rotational speed command from the speed command signal generator. In the control device, the speed command signal generator changes an acceleration running curve in a deceleration interval in accordance with the moving direction and the load of the car of the elevator to generate the rotational speed command.

13 Claims, 19 Drawing Sheets

U.S. PATENT DOCUMENTS

| | | | | | |
|---|---|---|---|---|---|
| 5,035,301 | A | * | 7/1991 | Skalski | 187/295 |
| 5,155,305 | A | * | 10/1992 | Horbruegger et al. | 187/293 |
| 5,325,036 | A | * | 6/1994 | Diethert et al. | 318/802 |
| 5,414,333 | A | * | 5/1995 | Tanahashi | 318/268 |
| 5,777,280 | A | * | 7/1998 | Braasch et al. | 187/393 |

FOREIGN PATENT DOCUMENTS

| | | |
|---|---|---|
| JP | 5-17079 | 1/1993 |
| JP | 9-227036 | 9/1997 |
| JP | 9-240935 | 9/1997 |
| JP | 2003-238037 | 8/2003 |

* cited by examiner

CONTROL DEVICE WITHOUT A SPEED SENSOR FOR CONTROLLING SPEED OF A ROTATING MACHINE DRIVING AN ELEVATOR

BACKGROUND OF THE INVENTION

1. Field of the Invention

The present invention relates to a control device for a rotating machine of an elevator, for controlling the rotating machine which drives a hoisting machine of the elevator or the like, without using a speed sensor.

2. Description of the Related Art

In a conventional control device for a rotating machine of an elevator, an inverter having no speed sensor is applied to the control of the elevator with a view to controlling the rotating machine without using a speed sensor (see, e.g., Patent Document 1: JP 3260070 A).

In another control device for a rotating machine of an elevator, an adaptive flux observer is used to estimate a rotational speed with a view to controlling the rotating machine (induction machine) without using a speed detector (see, e.g., Non-patent Document 1: Transactions on the Institute of Electric Engineers Japan (IEEJ)-Industry Applications Society I-55 (1998), "Stability Analysis of Adaptive Flux Observer of Induction Motor in Regenerative Operation.").

In still another control device for a rotating machine, which controls the rotating machine (induction machine) without using a speed detector, with a view to preventing overcurrent stoppage of an elevator resulting from an increased load and enhancing the accuracy with which the elevator arrives on a floor, it is detected that an output current of an inverter has reached an overcurrent limit level lower than an overcurrent stoppage level, constant-speed control is performed at a speed at the time of the detection, and the same deceleration control as in the case of deceleration for a certain period of time is performed such that the same deceleration distance as in the case of deceleration according to a speed pattern is obtained when a riding car has reached a deceleration starting point (see, e.g., Patent Document 2: JP 05-017079 A).

However, the conventional arts have the following problems. In the conventional speed control device for the rotating machine disclosed in Patent Document 1, for example, the output of a slip frequency command is changed in accordance with the load of a car in an acceleration interval in which a frequency command for an inverter is in the process of reaching a predetermined value after the operation of the elevator has been started. However, the running curve of the elevator is held constant regardless of the load of the car in a deceleration interval in which the car is in the process of stopping after the frequency command for the inverter has reached the predetermined value.

In the conventional control device for the rotating machine disclosed in Patent Document 2, when the control is performed without using a speed detector, deteriorations in control stability and control performance are observed in a low-speed regenerative range. Therefore, a speed pattern according to which a maximum deceleration is reduced in advance so as to prevent the entrance into the low-speed regenerative range must be used. As a result, the time for deceleration is prolonged regardless of the live load of the car of the elevator, so there is caused a problem in that the moving time of the elevator is prolonged.

If the speed pattern with restricted deceleration is not used, the moving time of the elevator is not prolonged, but a problem such as a deterioration in riding comfort arises due to a decrease in stability resulting from the passage through the low-speed regenerative range. Further, in Non-patent Document 1, the observer needs to be separately designed with high stability.

SUMMARY OF THE INVENTION

The present invention has been made to solve the above-mentioned problems, and it is therefore an object of the present invention to obtain a control device for a rotating machine of an elevator which makes it possible, without using a speed detector, to suppress an increase in the moving time of the elevator while securing control performance and stability in accordance with the moving direction and load of a car of the elevator.

According to the present invention, there is provided a control device for a rotating machine of an elevator for performing speed control of the rotating machine of the elevator without using a speed sensor, the control device including: speed command signal generating means for generating a rotational speed command for the rotating machine; and speed sensor-less control means for controlling a voltage applied to the rotating machine without using the speed sensor, based on the rotational speed command from the speed command signal generating means, in which the speed command signal generating means changes an acceleration running curve in a deceleration interval in accordance with a moving direction and a load of a car to generate the rotational speed command.

Further, according to the present invention, there is provided a control device for a rotating machine of an elevator for performing speed control of the rotating machine of the elevator without using a speed sensor, the control device including: speed command signal generating means for generating a rotational speed command for the rotating machine; speed sensor-less control means for controlling a voltage applied to the rotating machine without using a speed sensor, based on the rotational speed command from the speed command signal generating means; and a brake for applying a braking torque to the rotating machine, in which the speed sensor-less control means makes the braking torque of the brake effective to compensate for a deficiency in regenerative torque in a deceleration interval in accordance with a moving direction and a load of a car of the elevator such that a constant acceleration running curve is obtained regardless of the load of the car.

DESCRIPTION OF THE PREFERRED EMBODIMENTS

Preferred embodiments of a control device for a rotating machine of an elevator according to the present invention will be described hereinafter with reference to the drawings.

The control device for the rotating machine of the elevator according to the present invention changes an acceleration running curve in a deceleration interval in accordance with a load of the elevator, thereby securing both control performance and stability.

First Embodiment

Figure 1:
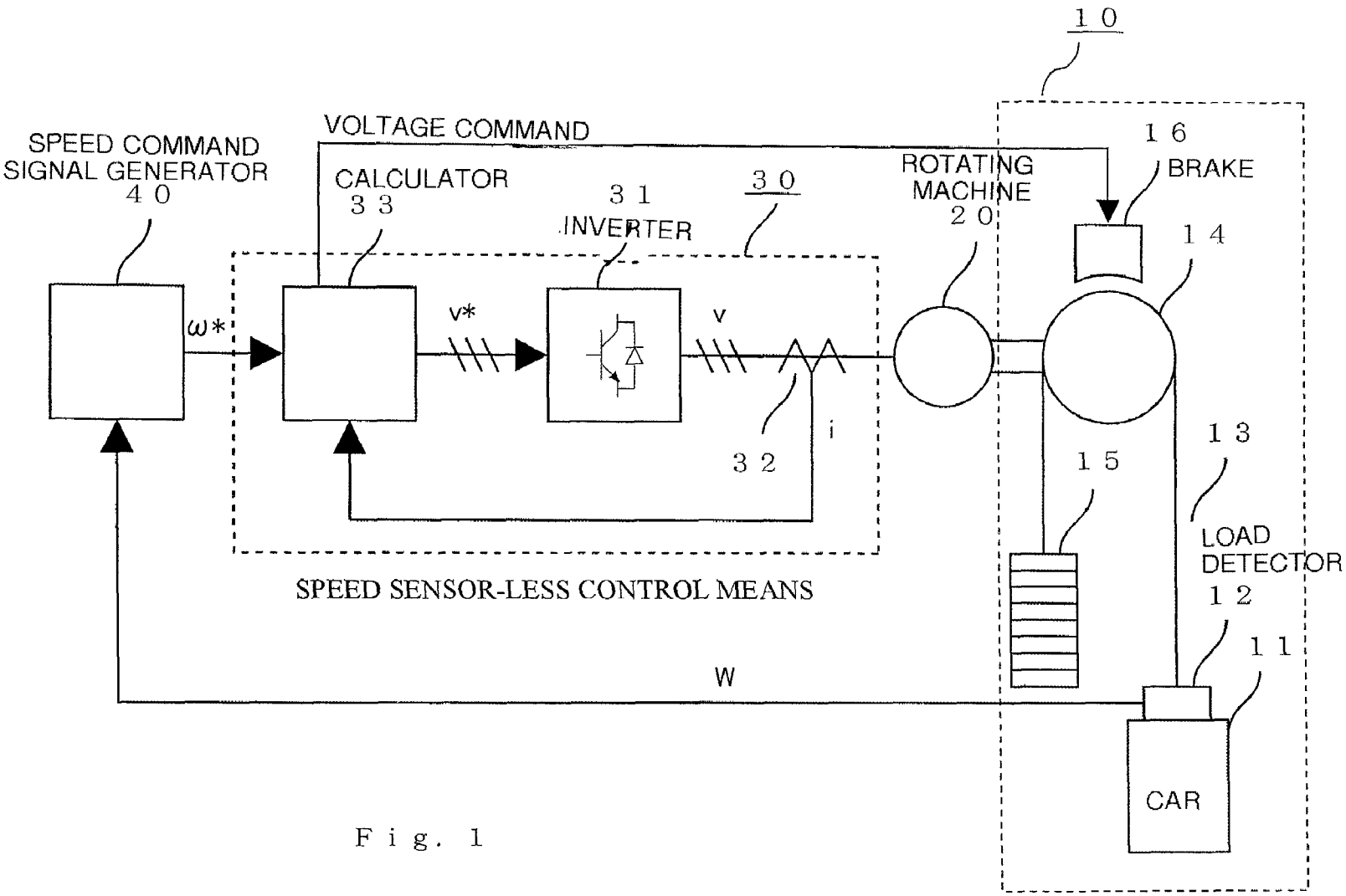
FIG. 1 is a schematic diagram of a control device for a rotating machine of an elevator according to Embodiment 1 of the present invention.

FIG. 1 is a schematic diagram of a control device for a rotating machine of an elevator according to Embodiment 1 of the present invention. The control device for the rotating machine of the elevator is composed of an elevator mechanism portion 10, a rotating machine 20, speed sensor-less control means 30, and speed command signal generating means 40.

The elevator mechanism portion 10 as a control object is composed of a car 11, an in-car load detector 12, a hoisting rope 13, a hoisting sheave 14, a counterweight 15, and a brake 16. The in-car load detector 12 is provided on the car 11, and the counterweight 15 is fitted to the car 11 via the hoisting sheave 14 by the hoisting rope 13. The brake 16 brakes the hoisting sheave 14 before the rotating machine 20 starts rotating and after the rotating machine 20 stops rotating. The rotating machine 20 drives the hoisting sheave 14 to raise/lower the car 11.

The speed command signal generating means 40 has a storage portion (not shown) in which running curves extending over an acceleration interval, a constant-speed interval, and a deceleration interval are stored in advance so as to generate a speed command as a criterion for the car of the elevator. It should be noted herein that the running curves prescribe a speed pattern during the movement of the car of the elevator from a certain stop floor to a certain target floor, and that the running curves can be specified by a pattern of changes in speed, acceleration, or jerk with time.

Each of the running curves may have a plurality of speed patterns depending on a moving distance or a relationship between the stop floor and the target floor. Further, each of the running curves may also have speed patterns as criteria for the acceleration interval and the deceleration interval.

The speed command signal generating means 40 then generates a rotational speed command $\omega^*$ for the rotating machine 20 according to an output of the in-car load detector 12 and the stored running curves as time passes after the car 11 has started moving, and outputs the generated rotational speed command $\omega^*$ to a voltage command calculator 33. The generation of the rotational speed command $\omega^*$ will be described later in detail.

On the other hand, the speed sensor-less control means 30, which is composed of a PWM inverter 31, a current detector 32, and the voltage command calculator 33, applies a three-phase voltage v to the rotating machine 20 without having information on the speed of the rotating machine 20 input thereto.

More specifically, the voltage command calculator 33 generates a voltage command $v^*$ based on the rotational speed command $\omega^*$ generated by the speed command signal generating means 40 and a three-phase current i detected by the current detector 32 without having the rotational speed of the rotating machine 20 input thereto, and outputs the generated voltage command $v^*$ to the PWM inverter 31. Further, the PWM inverter 31 applies a three-phase voltage v to the rotating machine 20 based on the generated voltage command $v^*$.

Next, the operation of the control device for the rotating machine of the elevator based on the acceleration running curve and the braking torque of the brake will be described. First of all, the operation in the case where the acceleration running curve and the braking torque of the brake are not changed in accordance with the load of the car will be described.

Figure 2:
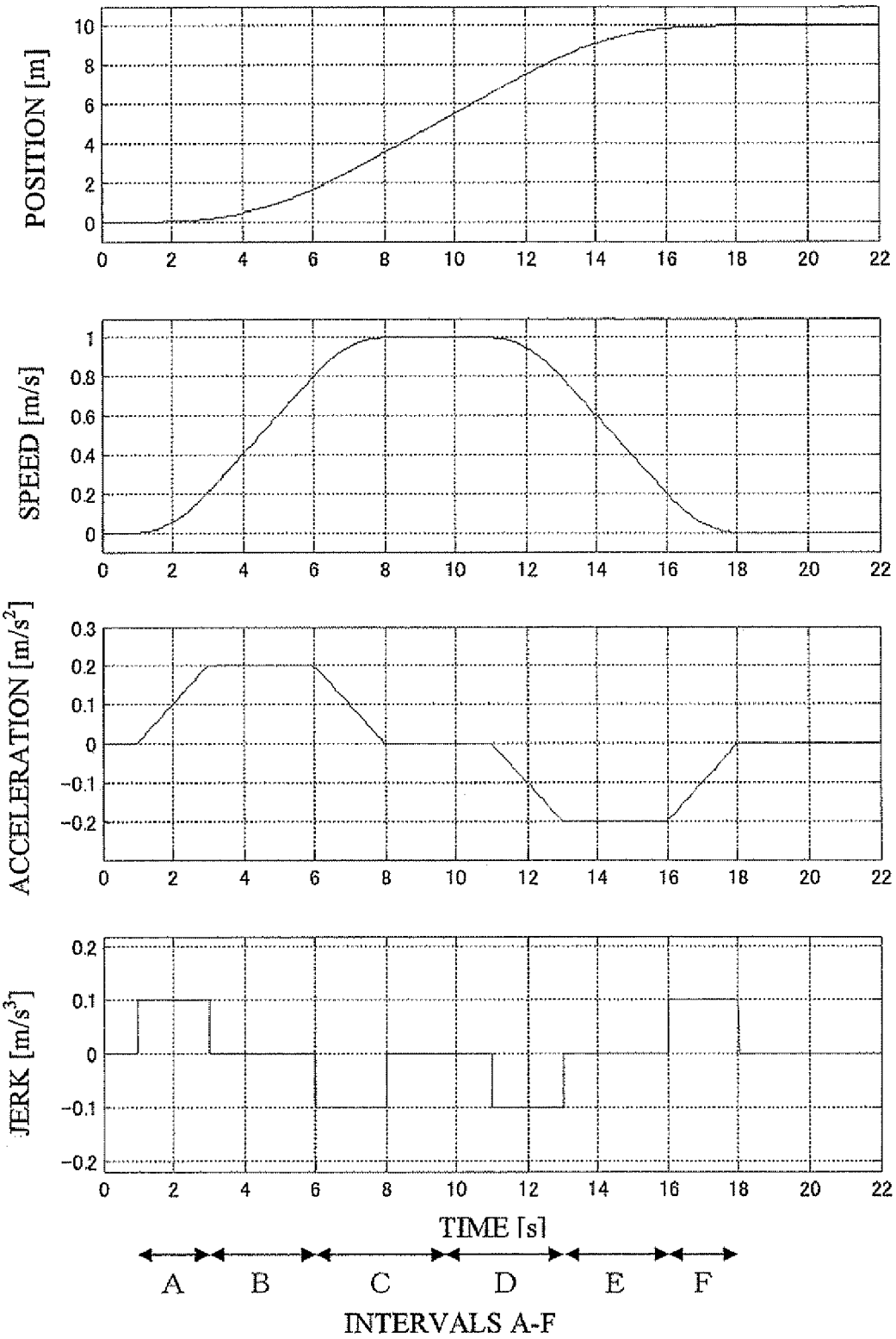
FIG. 2 is a diagram showing examples of running curves of the elevator during the raising of a car.

FIG. 2 is a diagram showing examples of running curves of the elevator during the raising of the car 11. In FIG. 2, the axes of abscissa represent time, and the axes of ordinate represent the position, speed, acceleration, and jerk of the car 11 respectively and sequentially from the top. The speed command signal generating means 40 has at least one of the running curves regarding position, speed, acceleration, and jerk stored in the storage portion, thereby making it possible to calculate a speed command that is generated as time passes after the start of the movement of the elevator.

Each of the running curves of the elevator in FIG. 2 can be divided into acceleration intervals (which correspond to intervals A, B, and C indicated in the bottom row of FIG. 2) in which the magnitude of the rotational speed of the rotating machine 20 is in the process of reaching a predetermined value, and deceleration intervals (which correspond to intervals D, E, and F indicated in the bottom row of FIG. 2) in which the car 11 is in the process of being stopped after the magnitude of the rotational speed of the rotating machine 20 has reached the predetermined value. In FIG. 2, no constant-speed interval is illustrated. Strictly speaking, however, a constant-speed interval is included, in accordance with the moving distance of the car 11, between the interval C as the last interval in the acceleration interval and the interval D as the first interval in the deceleration interval.

The details of the acceleration interval divided into the three intervals A, B, and C are as follows. In the interval A, the magnitude of acceleration increases. In the interval B, the magnitude of acceleration is held constant. In the interval C, the magnitude of acceleration decreases and then becomes zero. By the same token, the details of the deceleration interval divided into the three intervals D, E, and F are as follows. In the interval D, the magnitude of acceleration increases from zero. In the interval E, the magnitude of acceleration is held constant. In the interval F, the magnitude of acceleration decreases.

Figure 3:
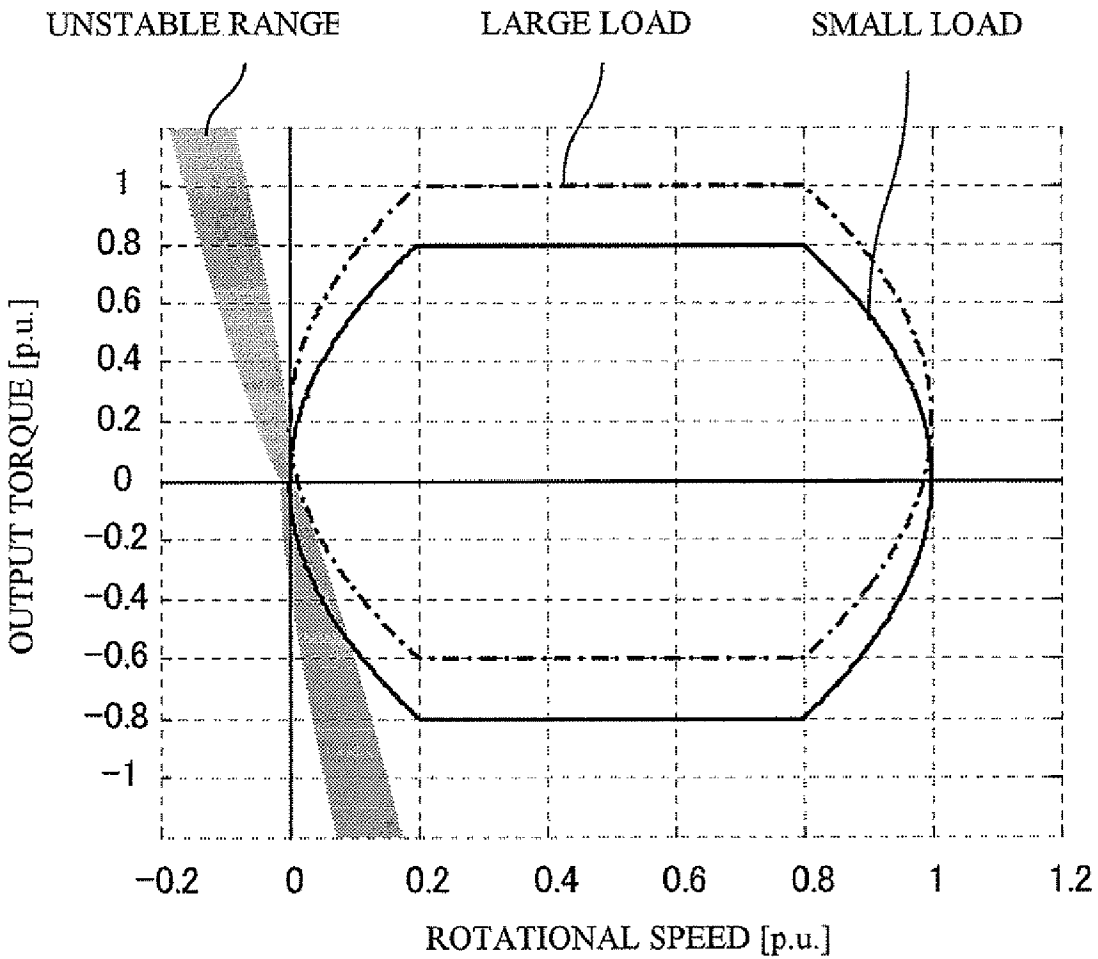
FIG. 3 is a diagram showing examples of running loci expressed by rotational speed and output torque during the performance of drive control of the rotating machine of the elevator according to the running curves of the elevator shown in FIG. 2.

FIG. 3 is a diagram showing examples of running loci expressed by rotational speed and output torque during the performance of drive control of the rotating machine of the elevator according to the running curves of the elevator shown in FIG. 2. In FIG. 3, the axis of ordinate represents the output torque output by the rotating machine 20, and the axis of abscissa represents the rotational speed of the rotating machine 20. The running loci shown in FIG. 3 indicate examples in which the inverse efficiency of a gear for connecting the hoisting sheave 14 and the rotating machine 20 together is low.

The operating point of each of the running loci shown in FIG. 3 draws a clockwise locus from the vicinity of an origin after the start of the elevator, passes through the first quadrant and the fourth quadrant, and then draws a locus returning to the vicinity of the origin again upon the stoppage of the elevator. In accordance with a difference between loads of the car 11, there arises a difference between the loci in the direction of the axis of ordinate. FIG. 3 shows, as a diagram corresponding to FIG. 2, the running loci during the raising of the car 11. A shift of locus toward a power running side is observed in the case where the load of the car 11 is large (as corresponds to the running locus indicated by alternate long and short dash lines in FIG. 3), and a shift of locus toward a regeneration side is observed in the case where the load of the car 11 is small (as corresponds to the running locus indicated by a solid line in FIG. 3).

In addition, an unstable range as a low-speed regenerative range in the case where an induction machine is used as the rotating machine 20 is illustrated in FIG. 3. It is apparent from a relationship between each of the running loci and the unstable range in FIG. 3 that the passage through the unstable range depends on the load of the car 11.

That is, in the case where the car 11 is raised, the unstable range is passed through when the load of the car 11 is small, but the unstable range is not passed through when the load of the car 11 is large. As will be described later, in the case where the car 11 is lowered, as opposed to the case where the car 11 is raised, the unstable range is passed through when the load of the car 11 is large, but the unstable range is not passed through when the load of the car 11 is small.

Figure 4:
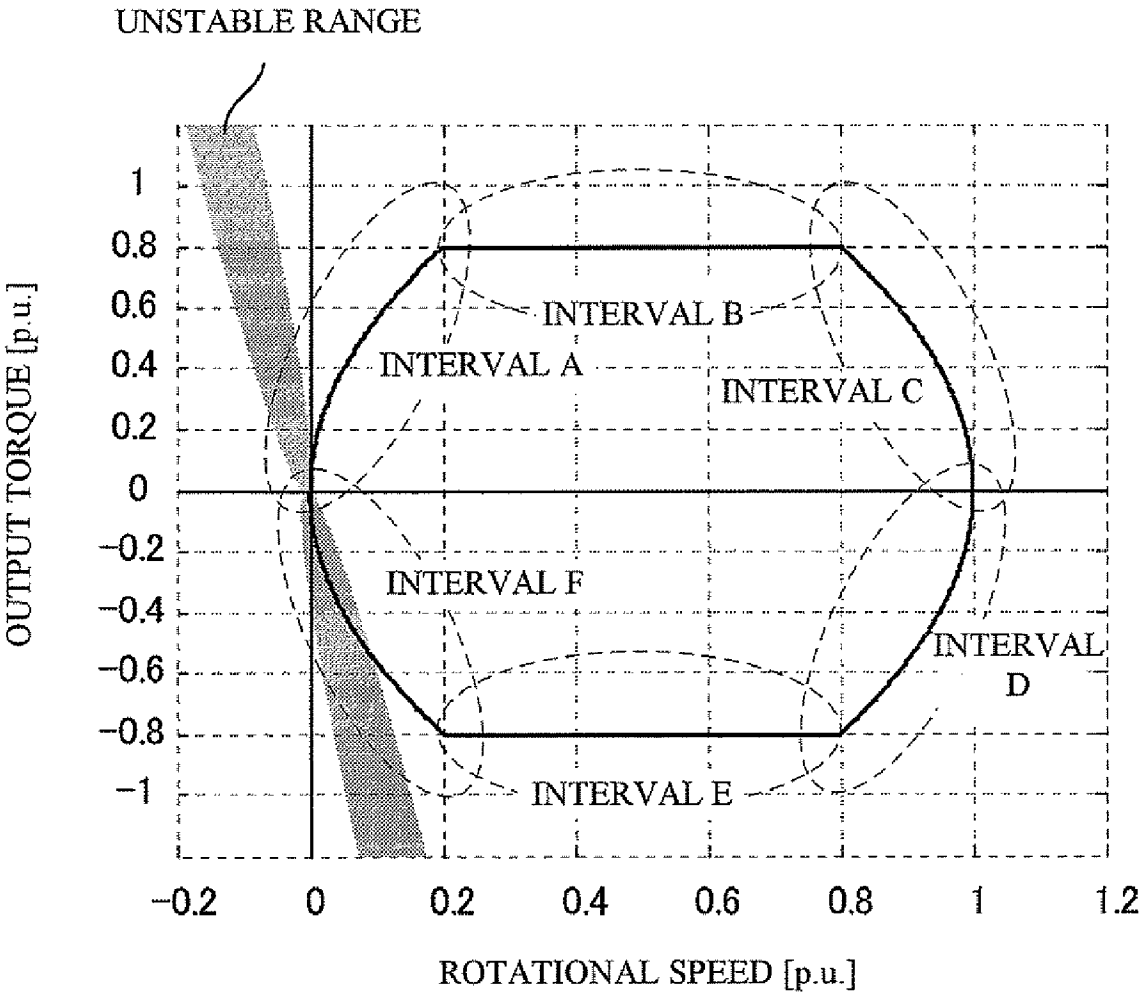
FIG. 4 is a diagram showing, in a sectionalized manner for intervals A to F, the running locus in the case where the load of the car is small in FIG. 3.

FIG. 4 is a diagram showing, in a sectionalized manner for the intervals A to F, the running locus in the case where the load of the car 11 is small in FIG. 3. In FIG. 4, the axis of ordinate represents the output torque output by the rotating machine 20, and the axis of abscissa represents the rotational speed of the rotating machine 20.

In FIG. 4, the elevator follows the locus in the interval A during the starting thereof, passes through the intervals B and C, and then reaches a rated speed. After that, the elevator starts decelerating from the interval D, passes through the intervals E and F, and then stops. During the raising of the car 11, it is apparent from the relationship between the running intervals and the unstable range in FIG. 3 that it is necessary to pay attention to the case where the load of the car 11 is small. More specifically, it is apparent from the relationship between the running intervals and the unstable range in FIG. 4 it is necessary to pay attention to the interval F precedent to the stoppage of the elevator.

Figure 5:
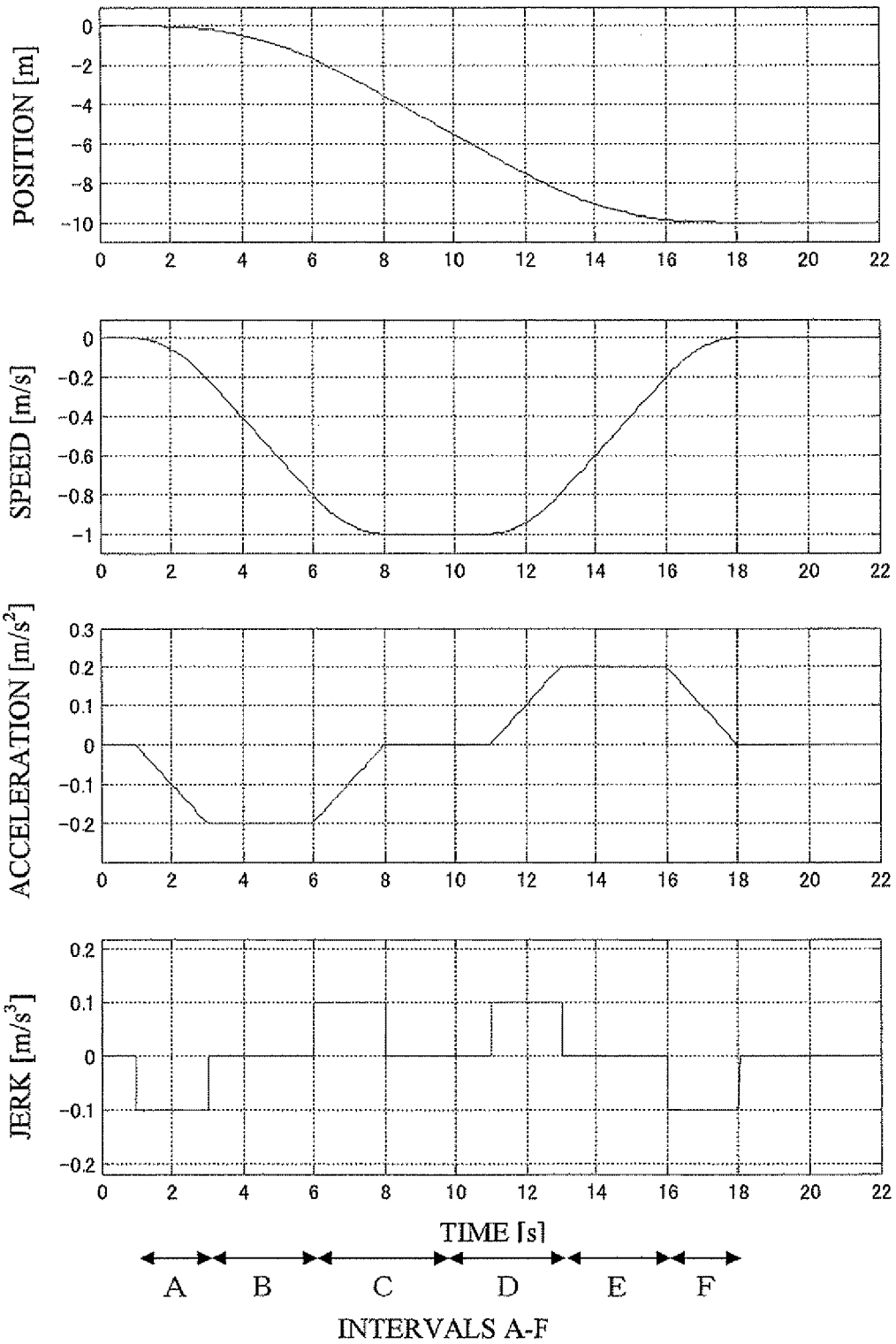
FIG. 5 is a diagram showing examples of running curves of the elevator during the lowering of the car.

FIG. 5 is a diagram showing examples of running curves of the elevator during the lowering of the car 11. FIG. 5 illustrates an operation that is reverse in direction to the operation of FIG. 2. In FIG. 5, the axes of abscissa represent time, and the axes of ordinate represent the position, speed, acceleration, and jerk of the car 11 respectively and sequentially from the top.

As is the case with the running curves of the elevator of FIG. 2, each of the running curves of the elevator in FIG. 5 can also be divided into the acceleration intervals (which correspond to the intervals A, B, and C indicated in the bottom row of FIG. 5) in which the magnitude of the rotational speed of the rotating machine 20 is in the process of reaching a predetermined values and the deceleration intervals (which correspond to the intervals D, E, and F indicated in the bottom row of FIG. 5) in which the car 11 is in the process of being stopped after the magnitude of the rotational speed of the rotating machine 20 has reached the predetermined value.

The details of the acceleration interval divided into the three intervals A, B, and C are as follows. In the interval A, the magnitude of acceleration increases. In the interval B, the magnitude of acceleration is held constant. In the interval C, the magnitude of acceleration decreases and then becomes zero. By the same token, the details of the deceleration interval divided into the three intervals D, E, and F are as follows. In the interval D, the magnitude of acceleration increases from zero. In the interval E, the magnitude of acceleration is held constant. In the interval F, the magnitude of acceleration decreases.

Figure 6:
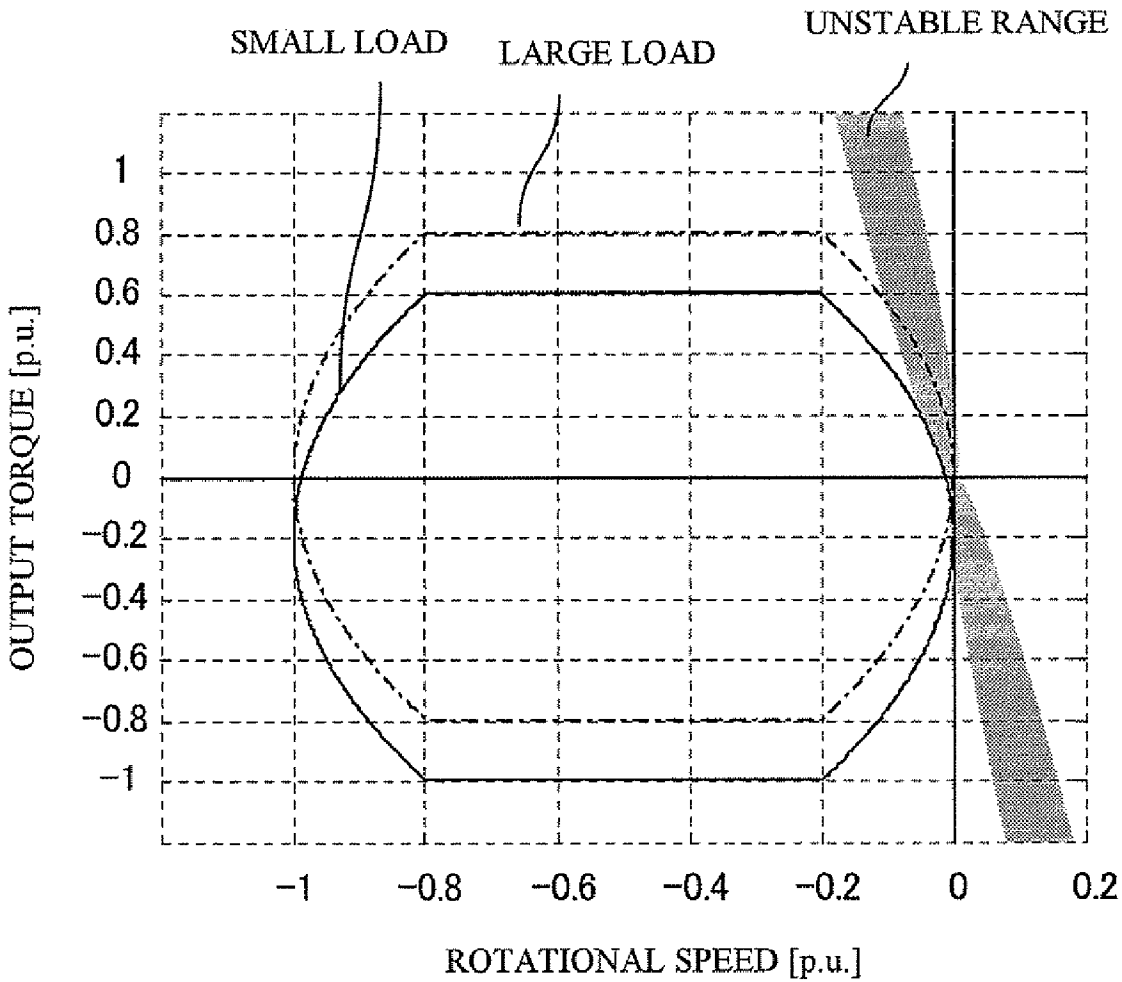
FIG. 6 is a diagram showing examples of running loci expressed by rotational speed and output torque during the performance of drive control of the rotating machine of the elevator according to the running curves of the elevator shown in FIG. 5.

FIG. 6 is a diagram showing examples of running loci expressed by rotational speed and output torque during the performance of drive control of the rotating machine of the elevator according to the running curves of the elevator shown in FIG. 5. In FIG. 6, the axis of ordinate represents the output torque output by the rotating machine 20, and the axis of abscissa represents the rotational speed of the rotating machine 20.

The operating point of each of the running loci shown in FIG. 6 draws a clockwise locus from the vicinity of an origin after the starting of the elevator, passes through the second quadrant and the third quadrant, and then draws a locus returning to the vicinity of the origin again upon the stoppage of the elevator. In accordance with a difference between loads of the car 11, there arises a difference between the loci in the direction of the axis of ordinate. FIG. 6 shows, as a diagram corresponding to FIG. 5, the running loci during the lowering of the car 11. A shift of locus toward a power running side is observed in the case where the load of the car 11 is large (as corresponds to the running locus indicated by alternate long and short dash lines in FIG. 6), and a shift of locus toward a regeneration side is observed in the case where the load of the car 11 is small (as corresponds to the running locus indicated by a solid line in FIG. 6).

Further, an unstable range as a low-speed regenerative range in the case where an induction machine is used as the rotating machine 20 is illustrated in FIG. 6. It is apparent from a relationship between each of the running loci and the unstable range in FIG. 6 that the passage through the unstable range depends on the load of the car 11.

That is, in the case where the car 11 is lowered, the unstable range is passed through when the load of the car 11 is large, but the unstable range is not passed through when the load of the car 11 is small. As described above, in the case where the car 11 is raised, as opposed to the case where the car 11 is lowered, the unstable range is passed through when the load of the car 11 is small, but the unstable range is not passed through when the load of the car 11 is large.

Figure 7:
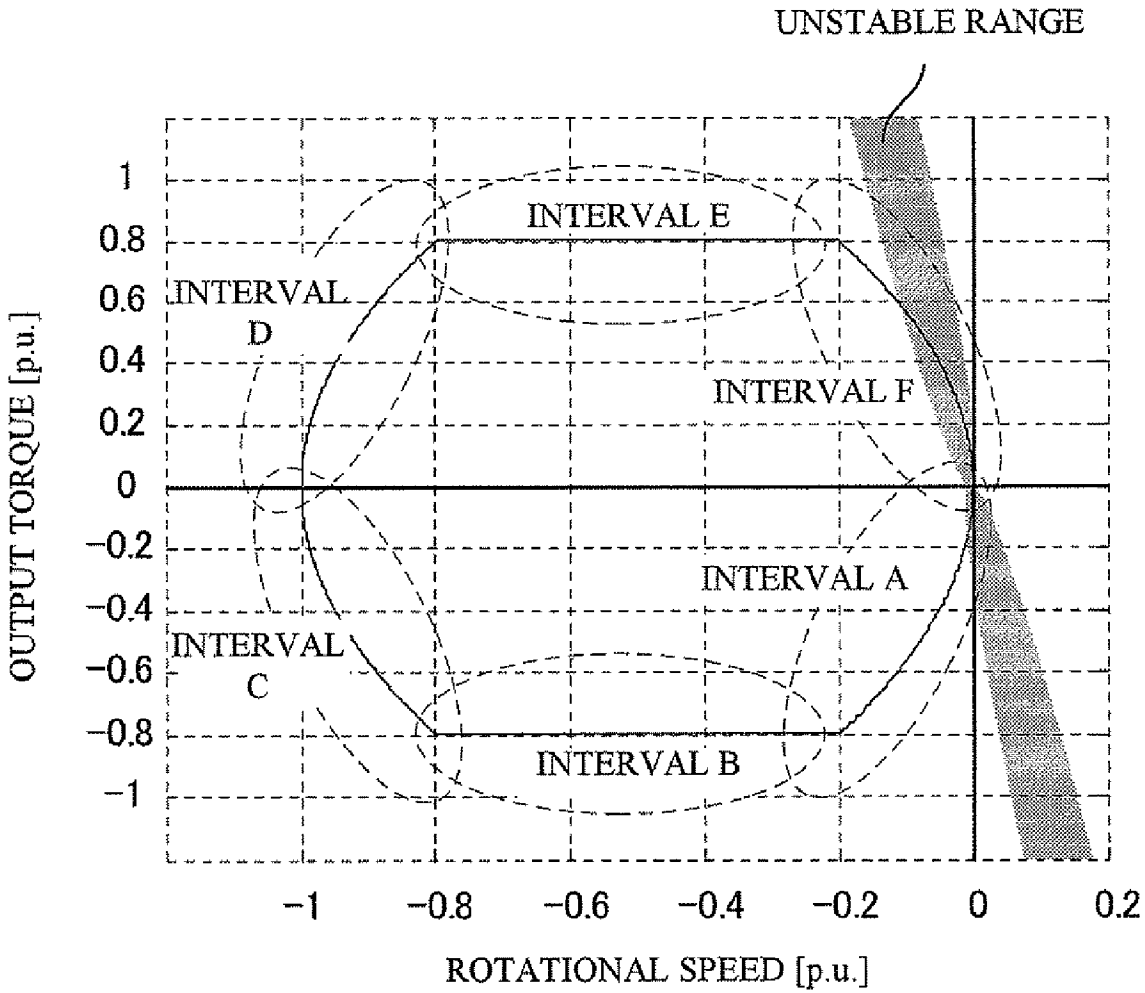
FIG. 7 is a diagram showing, in a sectionalized manner for the intervals A to F, the running locus in the case where the load of the car is large in FIG. 5.

FIG. 7 is a diagram showing, in a sectionalized manner for the intervals A to F, the running locus in the case where the load of the car 11 is large in FIG. 5. In FIG. 7, the axis of ordinate represents the output torque output by the rotating machine 20, and the axis of abscissa represents the rotational speed of the rotating machine 20.

In FIG. 7, the elevator follows the locus in the interval A during the starting thereof passes through the intervals B and C, and then reaches the rated speed. After that, the elevator starts decelerating from the interval D, passes through the intervals E and F, and then stops. During the lowering of the car 11, it is apparent from the relationship between the running intervals and the unstable range in FIG. 6 that it is necessary to pay attention to the case where the load of the car 11 is large. More specifically, it is apparent from the relationship between the running intervals and the unstable range in FIG. 7 that it is necessary to pay attention to the interval F precedent to the stoppage of the elevator.

It is apparent from the foregoing that it is necessary to pay attention to the following two respects.

(1) In the case where the speed sensor-less control means 30 is used, it is necessary to pay attention to the interval F precedent to the stoppage of the elevator, regardless of whether the car 11 is raised or lowered.

(2) In the case where the car 11 is raised, it is necessary to pay more attention as the load of the car 11 decreases. In the case where the car 11 is lowered, it is necessary to pay more attention as the load of the car 11 increases.

Figure 8:
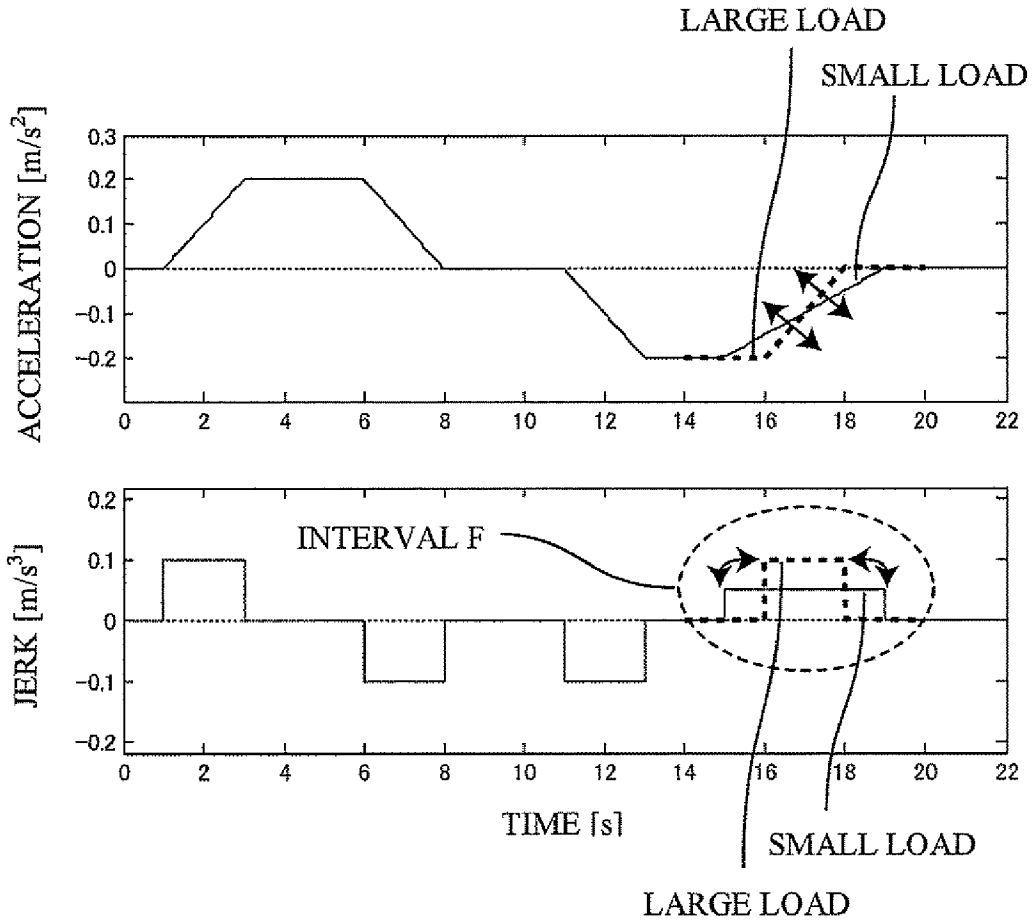
FIG. 8 is a diagram showing examples of running curves of the elevator during the raising of the car in Embodiment 1 of the present invention.

In the light of the foregoing, the operating principle of the control device for the rotating machine of the elevator according to Embodiment 1 of the present invention will now be described. FIG. 8 is a diagram showing examples of running curves of the elevator during the raising of the car 11 in Embodiment 1 of the present invention. In FIG. 8, the axes of abscissa represent time, and the axes of ordinate represent acceleration and jerk respectively and sequentially from the top.

In the acceleration running curve of the elevator in FIG. 8, there is no problem in the stability of the speed sensor-less control means 30 from the aforementioned interval A to the aforementioned interval E. In the intervals A to E, therefore, the acceleration running curve shown in FIG. 8 is identical to the acceleration running curve shown in FIG. 2. In the interval F during the raising of the car 11, however, when the load of the car 11 is small, running curves according to which the magnitude of maximum jerk is smaller than in the case of the normal running curves are adopted with attention paid to the unstable range (as corresponds to solid lines in the interval F of FIG. 8).

In the interval F during the raising of the car 11, when the load of the car 11 is large, there is no need to pay attention to the unstable range as described above. Therefore, the same running curves as shown in FIG. 2 are adopted (as corresponds to dotted lines in the interval F of FIG. 8).

As described above, the magnitude of maximum jerk is reduced and the allocated period thereof is prolonged, so the period in the interval F in which changes in acceleration are observed is prolonged. However, the speed sensor-less control means 30 can achieve a reduction of low-speed regeneration torque, and hence can control the rotating machine 20 stably while avoiding the unstable range.

Figure 9:
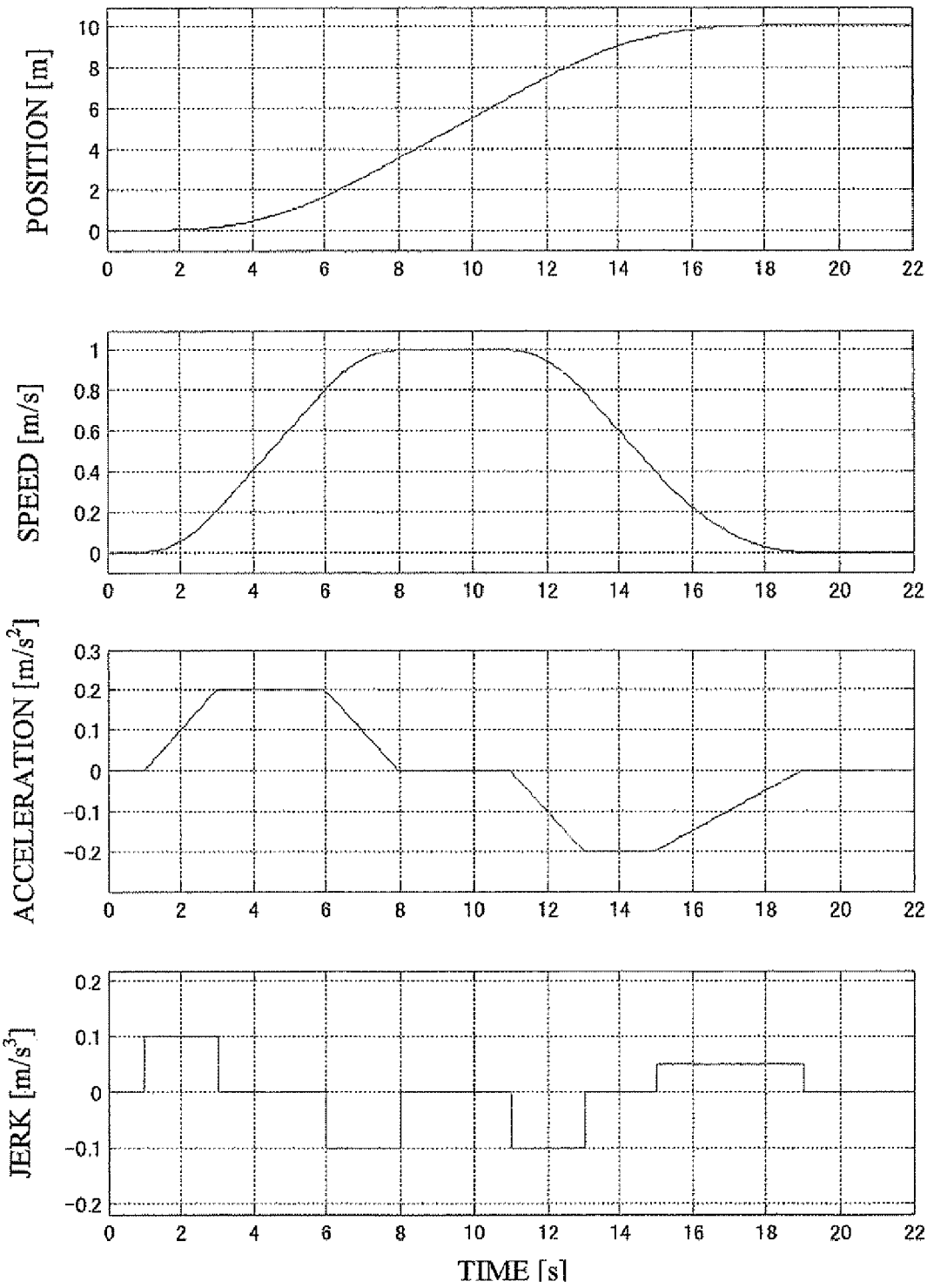
FIG. 9 is a diagram showing running curves of the elevator in the case where the load of the car is small during the raising thereof in Embodiment 1 of the present invention.

FIG. 9 is a diagram showing running curves of the elevator in the case where the load of the car 11 is small during the raising thereof in Embodiment 1 of the present invention. As described with reference to FIG. 8, in the interval F during the raising of the car 11, when the load of the car 11 is small, the magnitude of the maximum jerk during deceleration is reduced to increase the allocated period of deceleration jerk and increase the allocated period of deceleration time.

Figure 10:
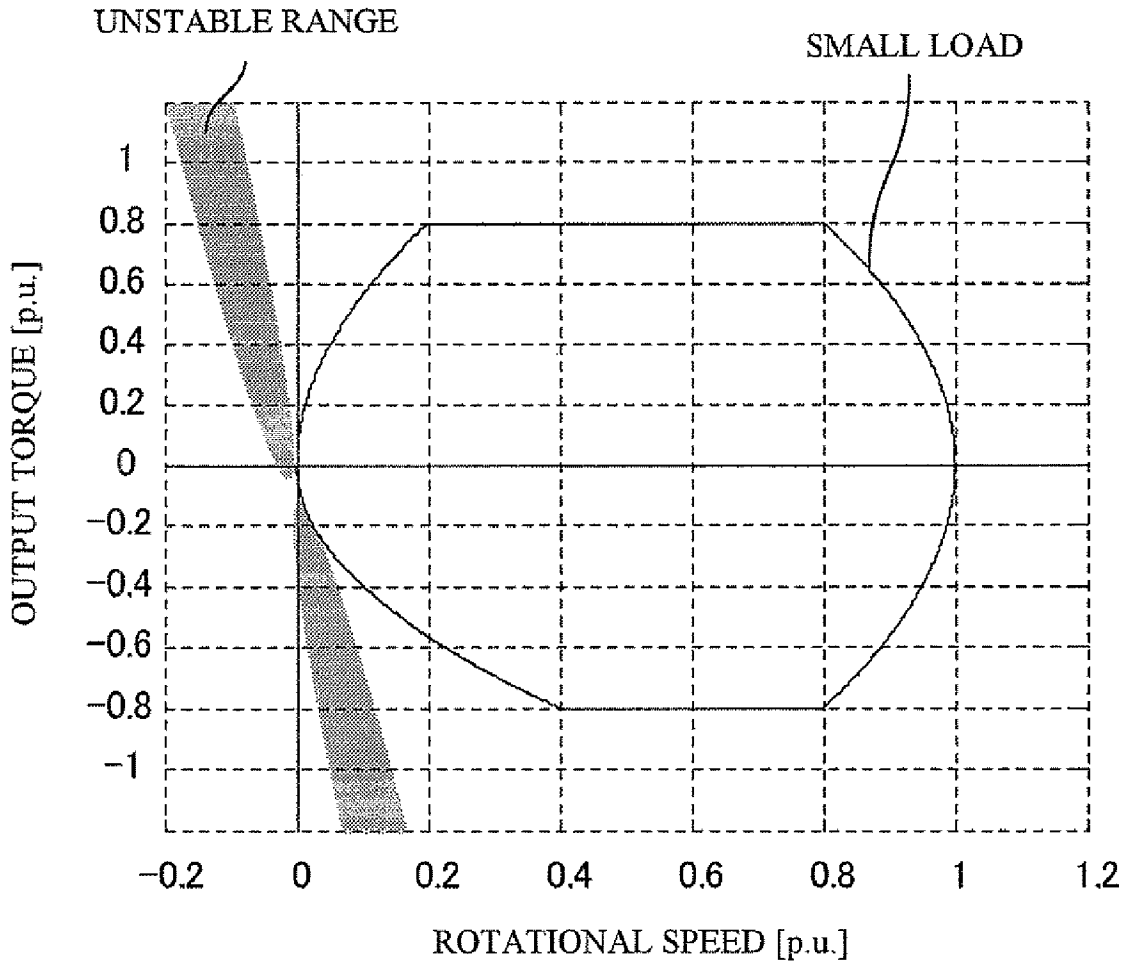
FIG. 10 is a diagram showing a running locus expressed by rotational speed and output torque during the performance of drive control of the rotating machine of the elevator according to the running curves of the elevator shown in FIG. 9.

FIG. 10 is a diagram showing a running locus expressed by rotational speed and output torque during the performance of drive control of the rotating machine of the elevator according to the running curve of the elevator shown in FIG. 9. In FIG. 10, the axis of ordinate represents the output torque output by the rotating machine 20, and the axis of abscissa represents the rotational speed of the rotating machine 20.

As shown in FIG. 10, in the interval F during the raising of the car 11 when the load of the car 11 is small, namely, when the rotating machine 20 needs a large regenerative torque in a low-speed range, the magnitude of the maximum jerk during deceleration is reduced to increase the allocated period of deceleration jerk and increase the allocated period of deceleration time. Thus, the speed sensor-less control means 30 can avoid the unstable range corresponding to low-speed regeneration.

That is, the acceleration running curve is changed in accordance with the load of the car 11, so the rotating machine 20 does not need a large regenerative torque in the low-speed range. As a result, the speed sensor-less control means 30 can avoid the low-speed regenerative range leading to instability.

The operation in the case where the load of the car 11 is small in the interval F during the raising of the car 11 has been described above with reference to FIGS. 8 to 10. However, with regard to the operation in the case where the load of the car 11 is large in the interval F during the lowering of the car 11 as well, the low-speed regenerative range leading to instability can be avoided in the same manner.

That is, when the load of the car 11 is large in the interval F during the lowering of the car 11 as well, the magnitude of the maximum jerk during deceleration is reduced to increase the allocated period of deceleration jerk and increase the allocated period of deceleration time. Thus, the speed sensor-less control means 30 can avoid the unstable range corresponding to low-speed regeneration.

Based on the foregoing principle, the speed command signal generating means 40 of FIG. 1 operates as follows to avoid the unstable range corresponding to low-speed regeneration. In outputting the rotational speed command $\omega^*$ in accordance with the running curves, the speed command signal generating means 40 changes the magnitude of the acceleration running curve in the interval F, which is stored in the storage portion, in accordance with a load W of the car 11.

That is, in raising the car, the speed command signal generating means 40 reduces the maximum of the magnitude of the jerk in the interval F as the load W of the car decreases, thereby increasing the allocated time of deceleration jerk in the interval F in the jerk running curve. In lowering the car, the speed command signal generating means 40 reduces the maximum of the magnitude of the jerk in the interval F as the load W of the car 11 increases, thereby increasing the allocated time of deceleration jerk in the interval F in the jerk running curve.

More specifically, the speed command signal generating means 40 has the acceleration running curves during the raising and lowering of the car 11, which have a relationship as described above, stored in advance in the storage portion in response to a plurality of loads, thereby making it possible to change the acceleration running curve in accordance with the load W of the car 11. Alternatively, the speed command signal generating means 40 may have the values of allocated period of deceleration interval and maximum jerk for load, which are mathematicized as function expressions separately during the raising of the car 11 and during the lowering of the car 11, stored in advance in the storage portion to make it possible to change the acceleration running curve in accordance with the load W of the car 11.

Further, the speed command signal generating means 40 may store a differentiated result of acceleration, namely, the jerk running curve instead of storing the acceleration running curve. Alternatively, the speed command signal generating means 40 may store an integrated result of acceleration, namely, the speed running curve instead of storing the acceleration running curve.

According to Embodiment 1 of the present invention, the speed command signal generating means changes in a decremental manner the magnitude of maximum jerk in the interval in which the magnitude of acceleration decreases in the deceleration interval precedent to the stoppage of the elevator, in accordance with the moving direction of the car and the load of the car, thereby making it possible to prolong the allocated time in which changes in acceleration are observed. Thus, the elevator is stopped in a normal deceleration period when the load W of the car is large during the raising thereof or when the load W of the car is small during the lowering thereof, so the running time required for the raising/lowering of the car 11 is not increased.

In addition, when the load W of the car is small during the raising thereof or when the load W of the car is large during the lowering thereof, the speed sensor-less control means can control the rotating machine in such a manner as to avoid the unstable range corresponding to low-speed regeneration. As a result, a control device for a rotating machine of an elevator which makes it possible to suppress an increase in the moving time of the elevator while securing control performance and stability in accordance with the load of a car of the elevator can be obtained.

In the aforementioned Embodiment 1 of the present invention, the method of changing only the time allocated to the interval F in accordance with the load of the car has been described. However, the present invention is not limited thereto. It is sufficient to change at least the allocated time of the interval F in accordance with the load of the car 11. It is also appropriate to collaterally change the allocated time lengths of the other intervals as well as the interval F in accordance with the load of the car 11. In this case as well, a similar effect can be achieved.

Second Embodiment

In Embodiment 1 of the present invention, the control device for the rotating machine of the elevator which changes the magnitude of maximum jerk in the interval F in accordance with the load W of the car has been illustrated. In Embodiment 2 of the present invention, a control device for a rotating machine of an elevator, which changes with time the rate of change in acceleration or jerk precedent immediately to the stoppage of the elevator instead of changing the magnitude of maximum jerk in the interval F, will be described. The control device for the rotating machine of the elevator according to Embodiment 2 of the present invention is constructed in the same manner as shown in FIG. 1.

Figure 11:
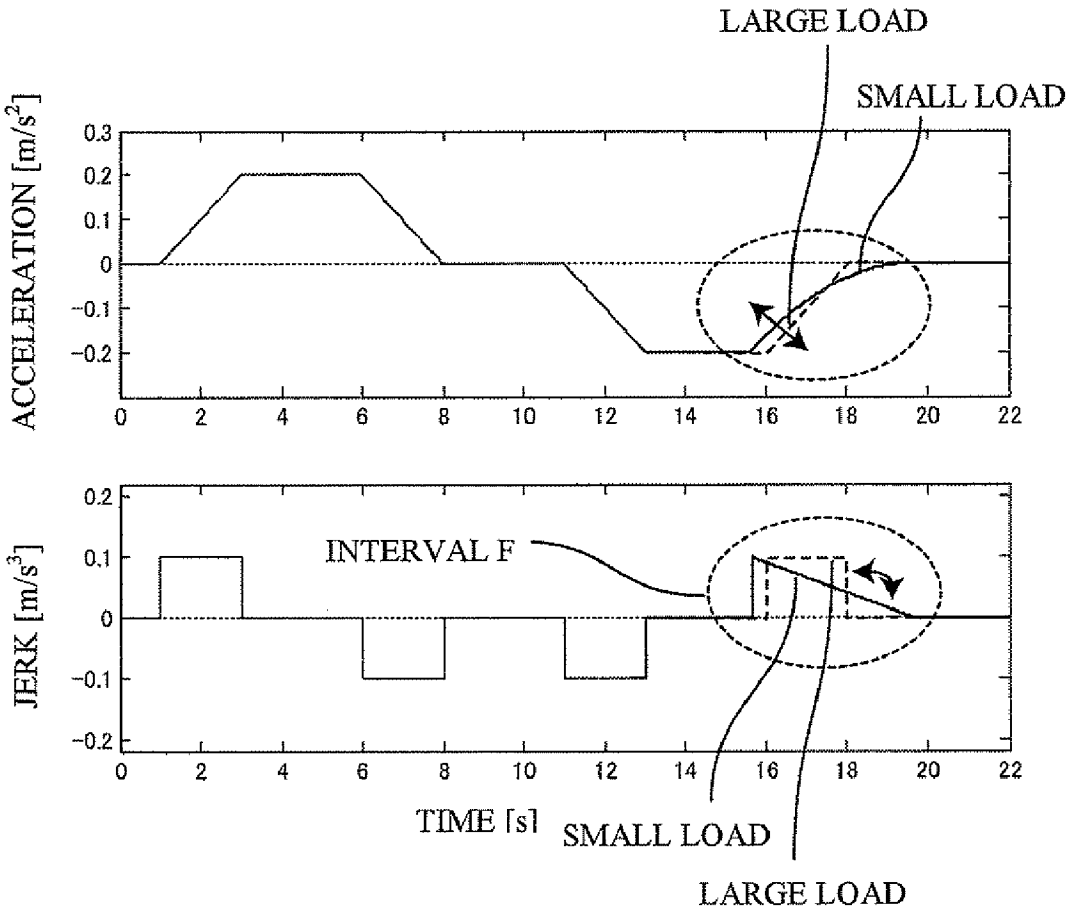
FIG. 11 is a diagram showing examples of running curves of the elevator during the raising of a car in Embodiment 2 of the present invention.

FIG. 11 is a diagram showing examples of running curves of the elevator during the raising of the car 11 according to Embodiment 2 of the present invention. In FIG. 11, the axes of abscissa represent time, and the axes of ordinate represent acceleration and jerk from the top.

As is the case with Embodiment 1 of the present invention, there is no problem in the stability of the speed sensor-less control means 30 from the interval A to the interval E. With regard to the interval F, when the load of the car is small during the raising thereof and when the load of the car is large during the lowering thereof, it is necessary to pay attention to the unstable range.

In Embodiment 1 of the present invention, as a measure to avoid the unstable range, the running curves are changed such that the magnitude of maximum jerk in the interval F becomes smaller than in the case of the normal running curves. In Embodiment 2 of the present invention, the period in the interval F in which changes in acceleration are observed is prolonged, and the jerk in the interval F is changed with time without changing the magnitude of maximum jerk in the interval F.

That is, in the interval F, when the load of the car 11 is small during the raising thereof, running curves according to which the jerk of the car 11 is changed with time unlike the case of the normal running curves are adopted with attention paid to the unstable range (as corresponds to solid lines in the interval F of FIG. 11). When the load of the car 11 is large during the raising thereof, there is no need to pay attention to the unstable range as described in Embodiment 1 of the present invention, so the same running curves as shown in FIG. 2 are adopted (as corresponds to dotted lines in the interval F of FIG. 11).

More specifically, the speed command signal generating means 40 has the acceleration running curves during the raising and lowering of the car 11, which have a relationship as described above, stored in advance in the storage portion in response to a plurality of loads, thereby making it possible to change the acceleration running curve in accordance with the load W of the car 11. Alternatively, the speed command signal generating means 40 may have the values of allocated period of deceleration interval and changes with time in the rates of changes in acceleration/deceleration for load, which are mathematicized as function expressions separately during the raising of the car 11 and during the lowering of the car 11, stored in advance in the storage portion to make it possible to change the acceleration running curve in accordance with the load W of the car 11.

As described above, the jerk of the car 11 is changed with time, and the period in the interval F in which changes in acceleration are observed is prolonged, so the speed sensor-less control means 30 can achieve a reduction of low-speed regenerative torque and hence control the rotating machine 20 stably.

Figure 12:
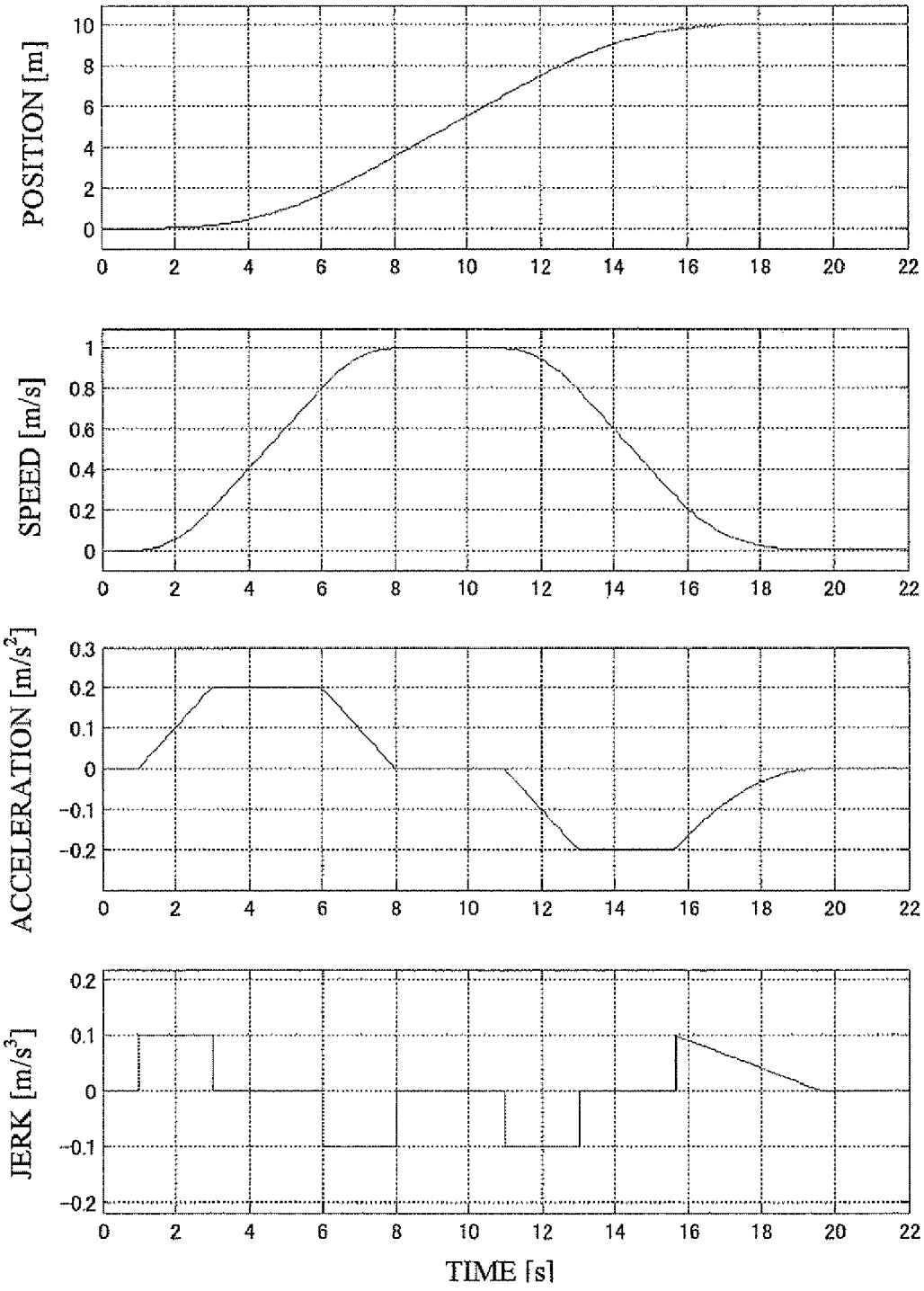
FIG. 12 is a diagram showing running curves of the elevator in the case where the load of the car is small during the raising thereof in Embodiment 2 of the present invention.

FIG. 12 is a diagram showing running curves of the elevator in the case where the load of the car 11 is small during the raising thereof in Embodiment 2 of the present invention. As described with reference to FIG. 11, when the load of the car 11 is small, the period in which the jerk during deceleration changes is prolonged to increase the allocated period of deceleration jerk and increase the allocated period of deceleration time.

Figure 13:
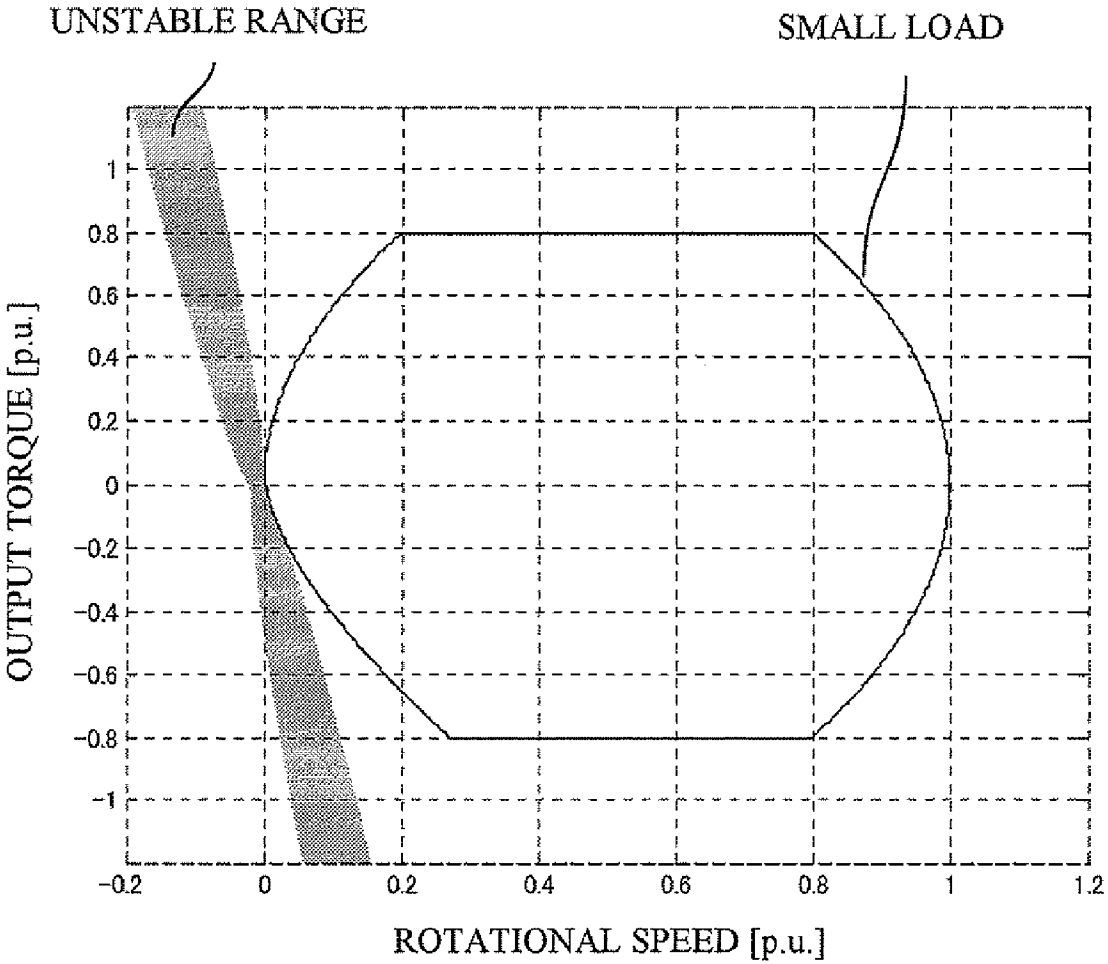
FIG. 13 is a diagram showing a running locus expressed by rotational speed and output torque during the performance of drive control of the rotating machine of the elevator according to the running curves of the elevator shown in FIG. 12.

FIG. 13 is a diagram showing running loci expressed by rotational speed and output torque during the performance of drive control of the rotating machine of the elevator according to the running curves of the elevator shown in FIG. 12. In FIG. 13, the axis of ordinate represents the output torque output by the rotating machine 20, and the axis of abscissa represents the rotational speed of the rotating machine 20.

As shown in FIG. 13, when the load of the car 11 is small in the interval F during the raising of the car 11, that is, when the rotating machine 20 needs a large regenerative torque in a low-speed range, the period in which the jerk during deceleration changes is prolonged to increase the allocated period of deceleration jerk and increase the allocated period of deceleration time, so the speed sensor-less control means 30 can avoid the unstable range corresponding to low-speed regeneration.

That is, the acceleration running curve is changed in accordance with the load of the car, so the rotating machine 20 does not need a large regenerative torque in the low-speed range. As a result, the speed sensor-less control means 30 can avoid the low-speed regenerative range leading to instability.

The foregoing description has been given as to the case where the car is raised. In the case where the car 11 is lowered, however, it is appropriate to prolong the period in the interval F in which changes in jerk are observed when the load of the car is large. Thus, the speed sensor-less control means 30 can avoid the low-speed regenerative range leading to instability in the same manner as in the case where the car is raised.

According to Embodiment 2 of the present invention, the speed command signal generating means 40 changes with time the jerk in the interval in which the magnitude of acceleration decreases in the deceleration interval precedent to the stoppage of the elevator, in accordance with the moving direction of the car and the load of the car, thereby making it possible to prolong the allocated time in which changes in acceleration are observed. Thus, the elevator is stopped in the normal deceleration period when the load W of the car is large during the raising thereof or when the load W of the car is small during the lowering thereof so the running time required for the raising/lowering of the car 11 is not increased.

In addition, when the load W of the car is small during the raising thereof or when the load W of the car is large during the lowering thereof, the speed sensor-less control means can control the rotating machine in such a manner as to avoid the unstable range corresponding to low-speed regeneration. As a result, a control device for a rotating machine of an elevator which makes it possible to suppress an increase in the moving time of the elevator while securing control performance and stability in accordance with the load of a car of the elevator can be obtained.

Third Embodiment

In Embodiment 1 of the present invention, the control device for the rotating machine of the elevator which changes the magnitude of maximum jerk in the interval F in accordance with the load W of the car has been illustrated. In Embodiment 2 of the present invention, the control device for the rotating machine of the elevator, which changes with time the rate of change in acceleration or jerk precedent immediately to the stoppage of the elevator instead of changing the magnitude of maximum jerk in the interval F, has been illustrated. In both of these Embodiments 1 and 2 of the present invention, the jerk and acceleration in the interval F are changed.

On the other hand, in Embodiment 3 of the present invention, description will be given as to a case where the jerk and acceleration of the car are changed in the intervals D to F corresponding to the deceleration intervals. The control device for the rotating machine of the elevator according to Embodiment 3 of the present invention is constructed in the same manner as shown in FIG. 1.

Figure 14:
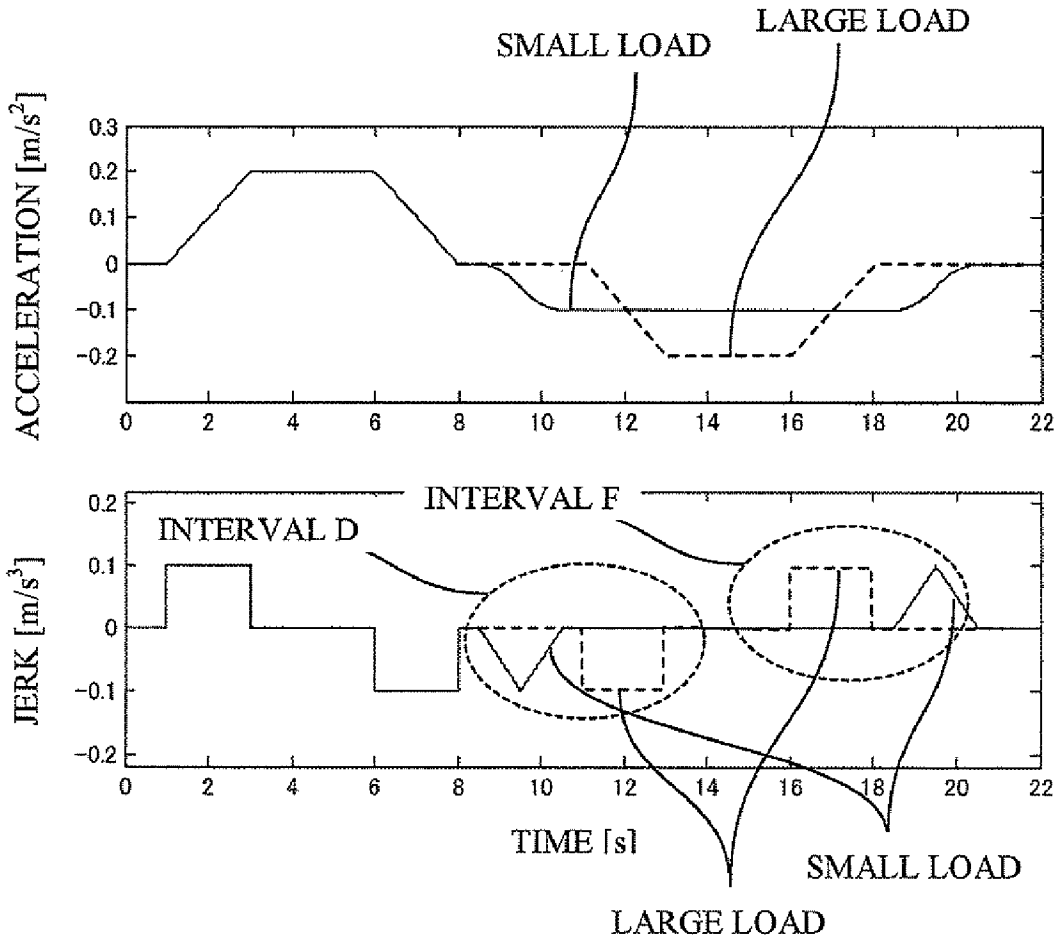
FIG. 14 is a diagram showing examples of running curves of an elevator during the raising of a car in Embodiment 3 of the present invention.

FIG. 14 shows examples of running curves of the elevator during the raising of the car 11 in Embodiment 3 of the present invention. In FIG. 14, the axes of abscissa represent time, and the axes of ordinate represent acceleration and jerk sequentially from the top. In the figure, there is no problem in the stability of the speed sensor-less control means 30 in the intervals A to C corresponding to the acceleration interval.

As described in Embodiment 1 of the present invention, when the load W of the car is small during the raising thereof, it is necessary to pay attention to the unstable range. In Embodiment 3 of the present invention, therefore, the alteration of the jerk running curve in the intervals D and F is conceived with a view to reducing the maximum acceleration in the interval E.

In Embodiment 1 of the present invention, the running curves are changed such that the magnitude of maximum jerk becomes smaller than that in the case of the normal running curves. On the other hand, in Embodiment 3 of the present invention, the period in the interval E in which the magnitude of acceleration is held constant is prolonged without changing the magnitude of maximum jerk itself.

That is, in the intervals D and F, when the load of the car 11 is small during the raising thereof, running curves according to which the jerk of the car 11 is changed with time into triangular shape unlike the case of the normal running curves are adopted with attention paid to the unstable range (as corresponds to solid lines in the intervals D and F of FIG. 11). When the load of the car 11 is large during the raising thereof, there is no need to pay attention to the unstable range as described in Embodiment 1 of the present invention, so the same running curves as shown in FIG. 2 are adopted (as corresponds to dotted lines in the intervals D and F of FIG. 14).

More specifically, the speed command signal generating means 40 has the acceleration running curves during the raising and lowering of the car 11, which have a relationship as described above, stored in advance in the storage portion in response to a plurality of loads, thereby making it possible to change the acceleration running curve in accordance with the load W of the car 11. Alternatively, the speed command signal generating means 40 may have the values of allocated period of deceleration interval and changes with time in the rates of changes in acceleration/deceleration for load, which are mathematicized as function expressions separately during the raising of the car 11 and during the lowering of the car 11, stored in advance in the storage portion to make it possible to change the acceleration running curve in accordance with the load W of the car 11.

As shown in FIG. 14, the jerk in each of the intervals D and F is changed with time, so the period of the intervals D to F is prolonged. However, the magnitude of acceleration itself can be reduced, so the speed sensor-less control means 30 can achieve a reduction of low-speed regenerative torque and hence control the rotating machine 20 stably.

Figure 15:
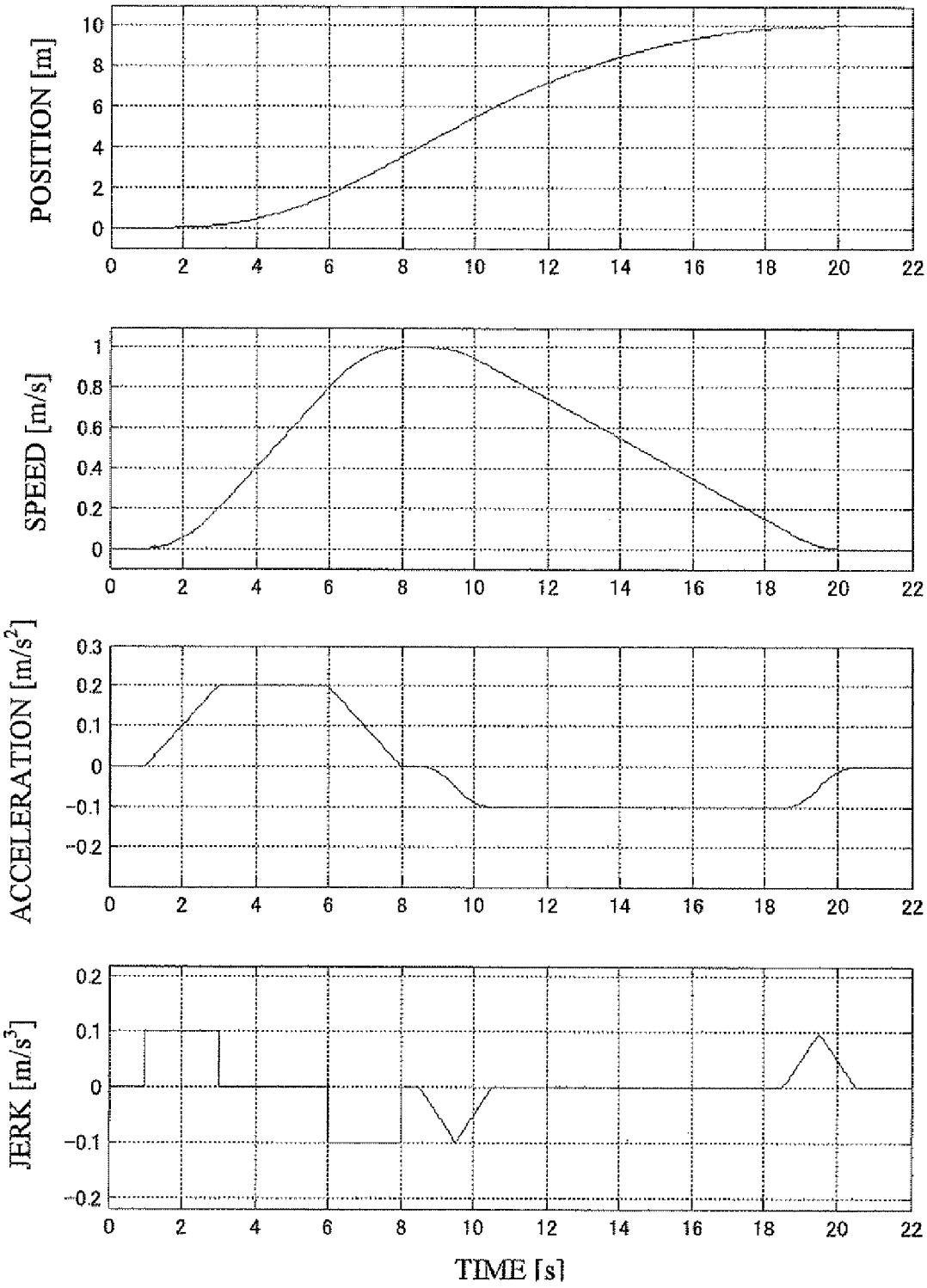
FIG. 15 is a diagram showing running curves of the elevator in the case where the load of the car is small during the raising thereof in Embodiment 3 of the present invention.

FIG. 15 is a diagram showing running curves of the elevator in the case where the load of the car 11 is small during the raising thereof in Embodiment 3 of the present invention. As described with reference to FIG. 14, when the load of the car 11 is small, the jerk in each of the intervals D and F is changed with time, so the period of the intervals D to F is prolonged. However, the magnitude of acceleration itself in the deceleration interval can be reduced.

Figure 16:
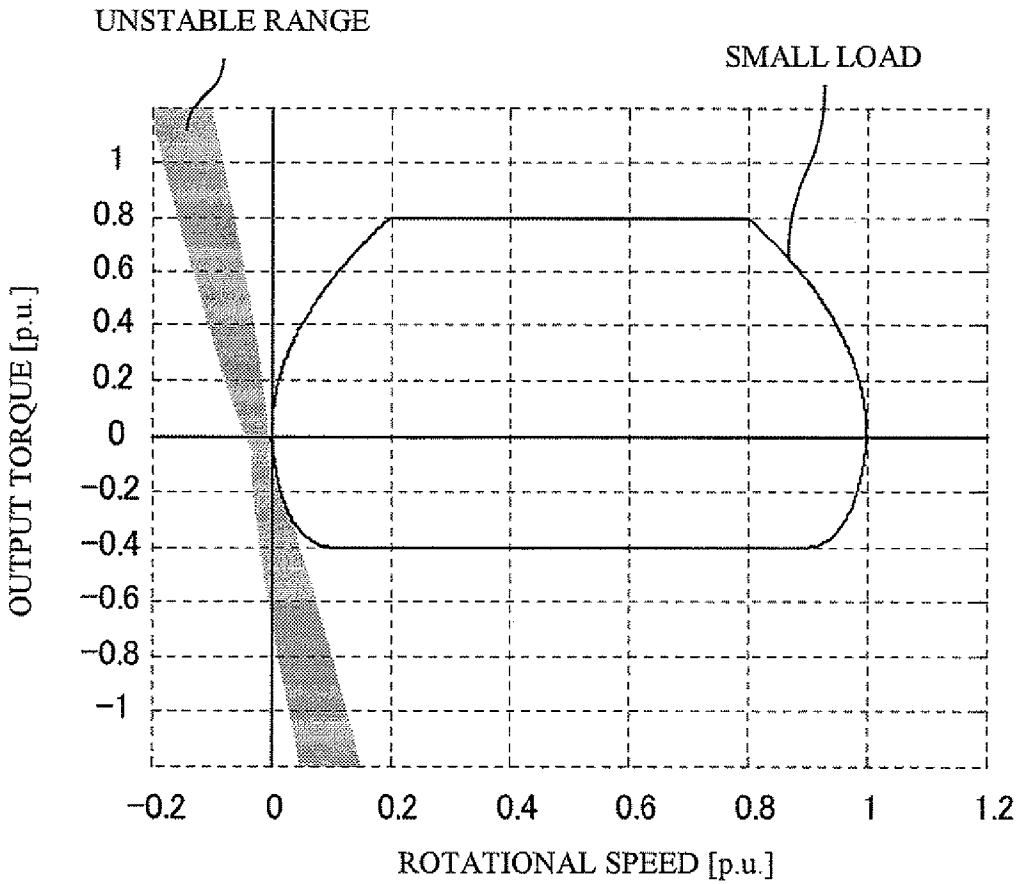
FIG. 16 is a diagram showing a running locus expressed by rotational speed and output torque during the performance of drive control of the rotating machine of the elevator according to the running curves of the elevator shown in FIG. 15.

FIG. 16 is a diagram showing examples of running loci expressed by rotational speed and output torque during the performance of drive control of the rotating machine of the elevator according to the running curves of the elevator shown in FIG. 15. In FIG. 16, the axis of ordinate represents the output torque output by the rotating machine 20, and the axis of abscissa represents the rotational speed of the rotating machine 20.

As shown in FIG. 16, when the load of the car 11 is small in the interval F during the raising of the car 11, that is, when the rotating machine 20 needs a large regenerative torque in a low-speed range, maximum acceleration during deceleration is suppressed to increase the allocated period of deceleration acceleration and increase the allocated period of deceleration time, so the speed sensor-less control means 30 can avoid the unstable range corresponding to low-speed regeneration.

That is, the acceleration running curve is changed in accordance with the load of the car, so the rotating machine 20 does not need a large regenerative torque in the low-speed range. As a result, the speed sensor-less control means 30 can avoid the low-speed regenerative range leading to instability.

The foregoing description has been given as to the case where the car is raised. In the case where the car is lowered, however, it is appropriate to change with time the jerk in each of the intervals D and F when the load of the car is large. Thus, the speed sensor-less control means 30 can avoid the low-speed regenerative range leading to instability in the same manner as in the case where the car is raised.

According to Embodiment 3 of the present invention, the speed command signal generating means changes with time the jerk in the deceleration interval precedent to the stoppage of the elevator in accordance with the moving direction of the car and the load of the car, thereby making it possible to reduce the magnitude of acceleration and prolong the allocated time in which changes in acceleration are observed. Thus, the elevator is stopped in the normal deceleration period when the load W of the car is large during the raising thereof or when the load W of the car is small during the lowering thereof, so the running time required for the raising/lowering of the car is not increased.

In addition, when the load W of the car is small during the raising thereof or when the load W of the car is large during the lowering thereof, the speed sensor-less control means can control the rotating machine in such a manner as to avoid the unstable range corresponding to low-speed regeneration. As a result, a control device for a rotating machine of an elevator which makes it possible to suppress an increase in the moving time of the elevator while securing control performance and stability in accordance with the load of a car of the elevator can be obtained.

Fourth Embodiment

Figure 17:
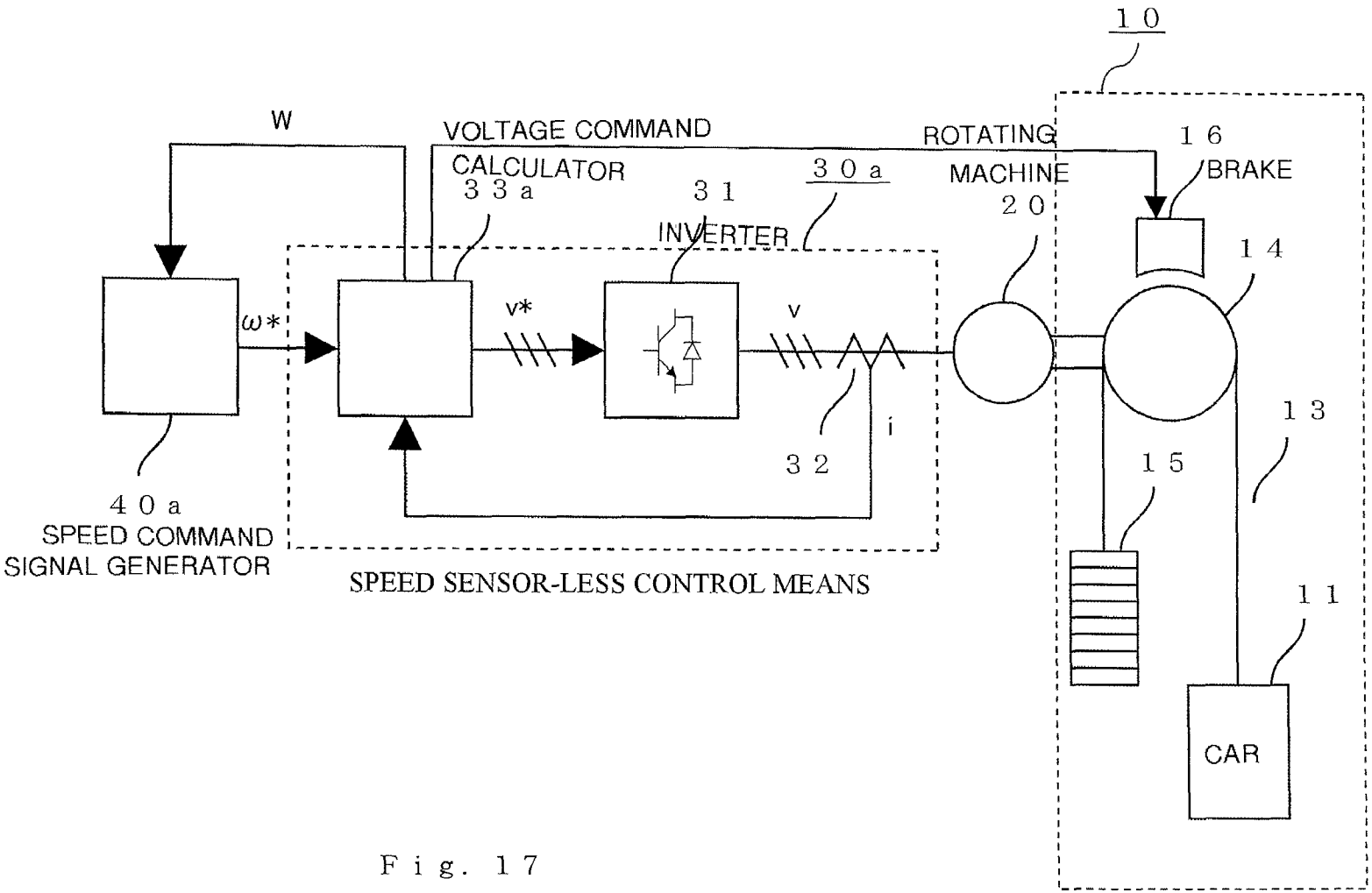
FIG. 17 is a schematic diagram of a control device for a rotating machine of an elevator according to Embodiment 4 of the present invention.

FIG. 17 is a schematic diagram of a control device for a rotating machine of an elevator according to Embodiment 4 of the present invention. FIG. 17 is different from FIG. 1, which is the schematic diagram of Embodiments 1 to 3 of the present invention, in that the in-car load detector 12 is not provided. In FIG. 17, the same reference symbols as in FIG. 1 denote component parts identical or corresponding to those of FIG. 1 respectively. The description of those component parts will be omitted. The following description will be centered on constructional details different from those of FIG. 1.

Speed sensor-less control means 30*a*, which is composed of the PWM inverter 31, the current detector 32, and a voltage command calculator 33*a*, applies a three-phase voltage to the rotating machine 20 without having information on the speed of the rotating machine 20 input thereto. In addition, the voltage command calculator 33*a* in the speed sensor-less control means 30*a* estimates a load of the car 11 based on a current obtained from the current detector 32, and outputs the estimated load of the car 11 to speed command signal generating means 40*a*. The estimation of the load of the car 11 will be described later.

The speed command signal generating means 40*a* generates the rotational speed command ω* for the rotating machine 20 according to an estimated value of the load W of the car 11 as an output of the voltage command calculator 33*a* and the stored running curves as time passes after the elevator has started moving, and outputs the generated rotational speed command ω* to the voltage command calculator 33*a*.

The construction of FIG. 1 is accompanied by the in-car load detector 12 provided on the car 11, thereby allowing the load of the car 11 to be measured with ease. On the other hand, according to the construction of FIG. 17, the voltage command calculator 33*a* can estimate the load of the car. As a result, the in-car load detector 12 shown in FIG. 1 is not required, and a signal line for connecting the in-car load detector 12 and the speed command signal generating means 40 together is not required either.

Next, it will be described how the voltage command calculator 33*a* constituting a technical feature of Embodiment 4 of the present invention performs the operations of estimating the load W of the car 11 based on the three-phase current i detected by the current detector 32 and outputting the estimated load W of the car 11 to the speed command signal generating means 40*a*.

Figure 18:
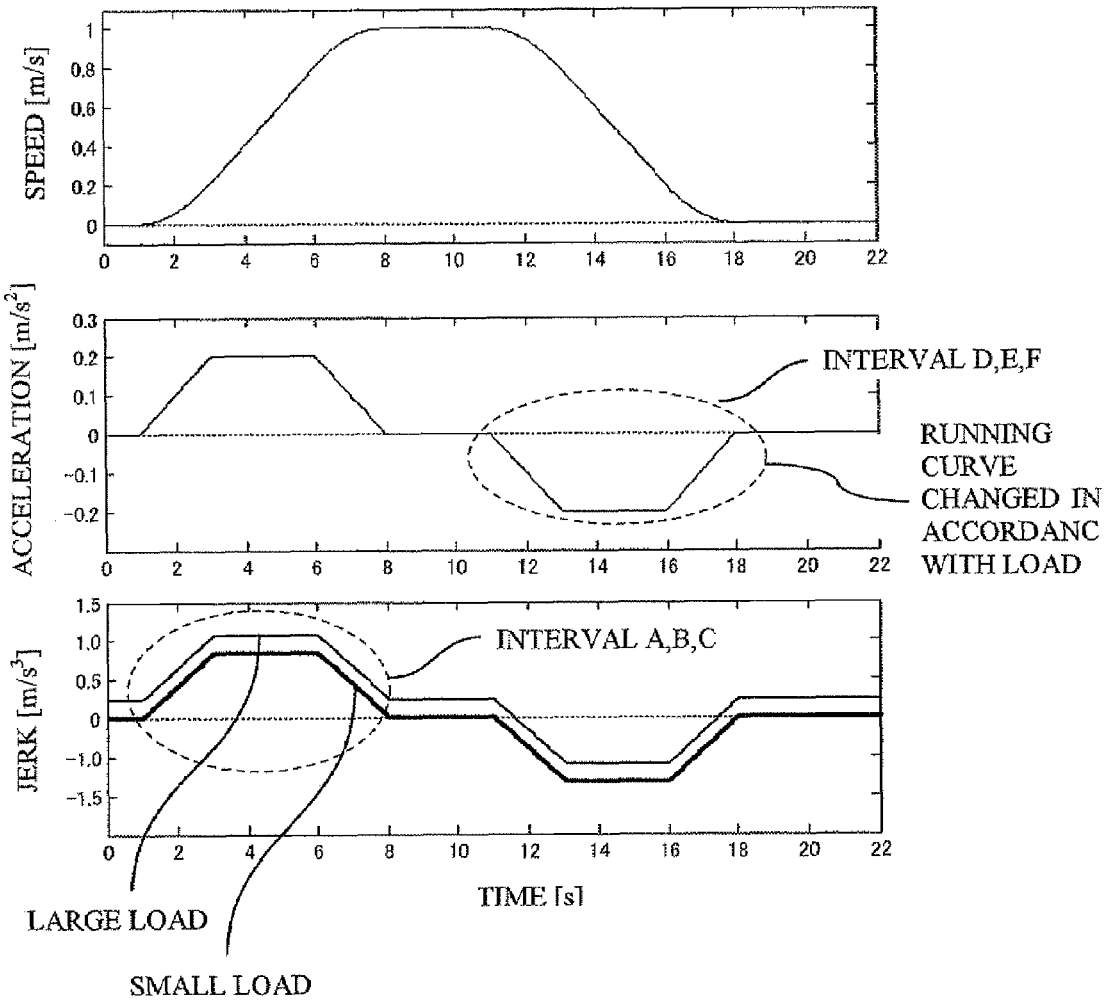
FIG. 18 is a diagram showing examples of running curves of the elevator during the raising of a car in Embodiment 4 of the present invention.

FIG. 18 is a diagram showing examples of running curves of the elevator during the raising of the car 11 in Embodiment 4 of the present invention. In FIG. 18, the axes of abscissa each represent time, and the axes of ordinate represent speed, acceleration, and torque current sequentially from the top.

It should be noted herein that the torque current in the third row is obtained by separating the current i output from the current detector 32 into an exciting current and a torque current using a known method based on coordinate transformation by dint of the voltage command calculator 33*a*.

In FIG. 18, in the intervals A, B, and C constituting the acceleration interval, a preset running curve regarding acceleration is given regardless of the load W of the car 11. As shown in the third row of FIG. 18, there is established a relationship in which the torque current in the case where the load is large shifts in an incremental direction in comparison with the torque current in the case where the load is small.

Thus, data on the torque current and load associated with each other are stored in advance in the storage portion, so the voltage command calculator 33*a* estimates a load of the car 11 based on a difference in response of torque current. The load of the car 11 can be estimated based on a torque current calculated from the current i output from the current detector 32.

The following methods are conceivable in calculating the value of torque current. For example, a determination on the load of the car 11 may be made according to the value of torque current at an arbitrary time. Alternatively, a determination on the load of the car 11 may be made according to the maximum value of torque current in one of the intervals A, B, and C. Alternatively, a determination on the load of the car 11 may be made according to the average of torque current in one of the intervals A, B, and C. The voltage command calculator 33*a* has data on the load corresponding to the torque current in one of the intervals A, B, and C stored in advance in the storage portion, thereby making it possible to estimate the load with ease.

When calculating the rotational speed command ω* in the intervals D to F constituting the deceleration period, the speed command signal generating means 40*a* needs the estimated value of the load. It is therefore appropriate that the voltage command calculator 33*a* estimates the load of the car 11 in the intervals A to C constituting the acceleration interval. The speed command signal generating means 40*a* changes the running curves in the intervals D, E, and F in accordance with the load of the car 11 based on the estimated load, by one of the methods described in Embodiments 1 to 3 of the present invention, thereby making it possible to reduce low-speed regenerative torque and hence to control the rotating machine 20 stably.

According to Embodiment 4 of the present invention, the voltage command calculator can estimate a load of the car 11 based on a torque current value. Therefore, a control device for a rotating machine of an elevator, which can suppress an increase in the moving time of the elevator while securing control performance and stability in accordance with the load of a car of the elevator in the same manner as in Embodiments 1 to 3 of the present invention without using an in-car load detector, can be obtained.

The foregoing description has been given as to the case where the car 11 is raised. In the case where the car is lowered as well, a preset running curve regarding acceleration is given regardless of the load of the car 11 in the intervals A, B, and C, so the response of torque current differs between the case where the load of the car 11 is large and the case where the load of the car 11 is small. Needless to say, therefore, the load of the car 11 can be estimated based on a difference in response of torque current in the same manner as in the case where the car 11 is raised.

The aforementioned Embodiment 4 of the present invention has been described as to the case where the voltage command calculator 33*a* has the data on the torque current and load associated with each other stored in advance in the storage portion to estimate the load of the car. However, the present invention is not limited thereto. The voltage command calculator 33*a* may also have functional expressions of calculated torque current and calculated load stored in advance in the storage portion to estimate the load of the car from the value of torque current.

In the aforementioned Embodiment 4 of the present invention, a torque current command value, namely, a torque command value may be used instead of the torque current. The voltage command calculator 33*a* may have a storage portion in which data on the torque command and load associated with each other are stored in advance, calculate a torque command required for causing a rotational speed to follow a rotational speed command, and acquire a load corresponding to a torque command in the acceleration interval of the elevator from the storage portion to estimate the load of the car. In this case as well, an effect similar to that of the aforementioned Embodiment 4 of the present invention can be achieved.

Fourth Embodiment

Embodiments 1 to 4 of the present invention have been described as to the case where the running curves in at least one of the intervals D, E, and F are changed in accordance with the load of the car 11. On the other hand, Embodiment 5 of the present invention will be described as to a case where the elevator is operated in the intervals D, E, and F with the aid of a brake torque of the brake 16 as well as a rotating machine torque of the rotating machine 20. The construction in Embodiment 5 of the present invention is the same as shown in FIG. 17.

Figure 19:
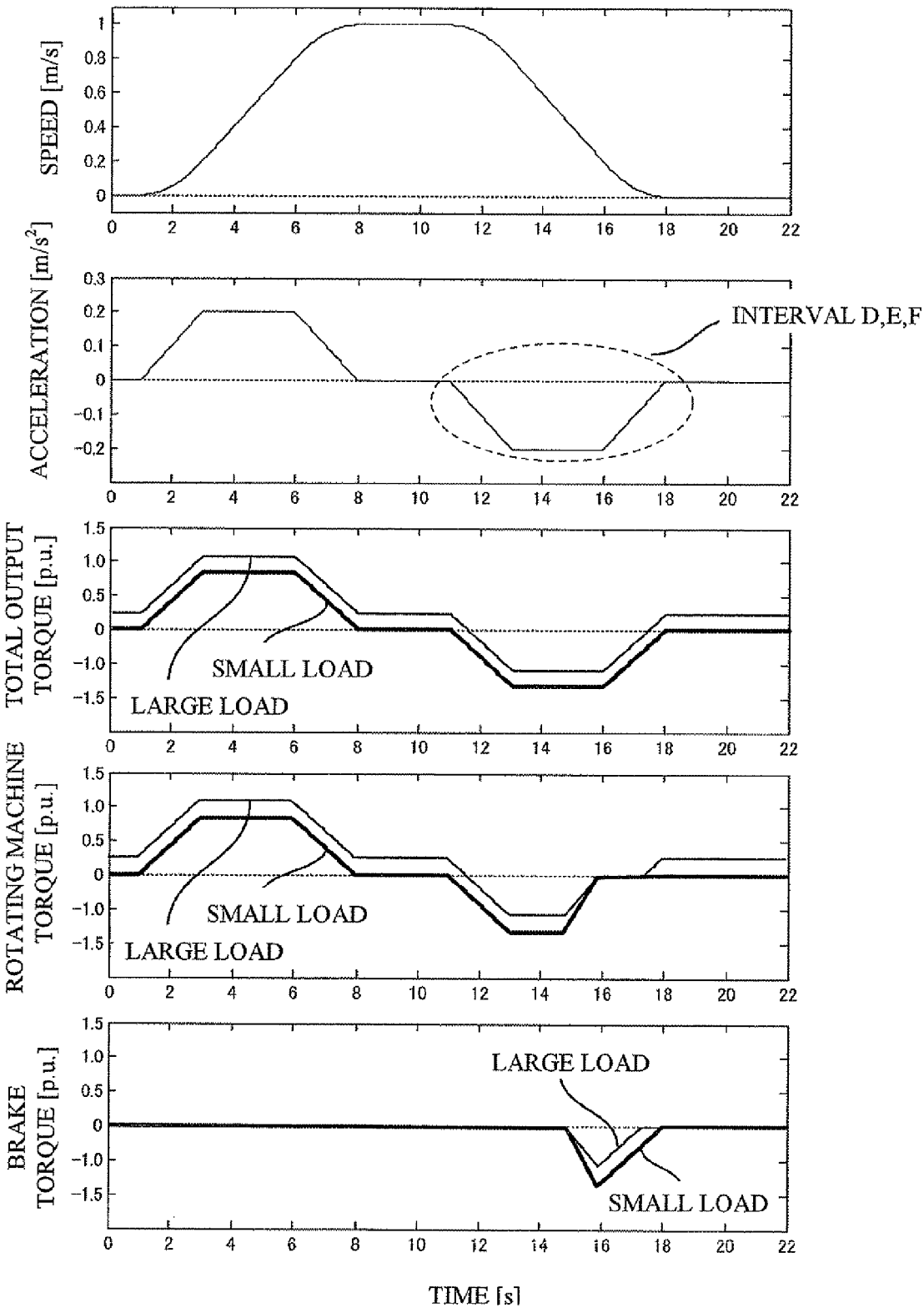
FIG. 19 is a diagram showing examples of running curves of an elevator during the raising of a car in Embodiment 5 of the present invention.

FIG. 19 is a diagram showing examples of running curves of the elevator during the raising of the car 11 in Embodiment 5 of the present invention. In FIG. 19, the axes of abscissa each represent time, and the axes of ordinate represent speed, acceleration, total output torque, rotating machine torque, and brake torque sequentially from the top.

The rotating machine torque means a torque output by the rotating machine 20, and the brake torque means a braking torque output by the brake 16. The total output torque is the sum of the rotating machine torque and the brake torque.

If the speed sensor-less control means 30 controls the rotating machine 20, both a power running torque and a regenerative torque can be output as the rotating machine torque, but the securement of stability in a low-speed regenerative range is not achieved with ease. The brake torque can be output by the brake 16, but only a regenerative torque can be output as the brake torque.

In respect of the total output torque, there is established a relationship that "total output torque" is equal to the sum of "rotating machine torque" and "brake torque".

Thus, the rotating machine torque and the brake torque are suitably combined with each other in the deceleration interval composed of the intervals D to F including the low-speed regenerative range, so the changes in the running curves in at least one of the intervals D, E, and F as made in Embodiments 1 to 4 of the present invention can be made unnecessary.

In Embodiment 4 of the present invention, the voltage command calculator 33*a* outputs a brake torque to the brake 16 before the elevator is raised/lowered and after the elevator has been raised/lowered, respectively. On the other hand, in Embodiment 5 of the present invention, as shown in FIG. 19, a brake torque is made effective in a specific interval within the deceleration interval instead of changing the running curves in accordance with the load of the car 11, with a view to achieving an effect similar to that of Embodiment 4 of the present invention.

In the low-speed regenerative range in the intervals D, E, and F, the voltage command calculator 33*a* in the speed sensor-less control means 30 controls the rotating machine 20 to cause a decrease in rotating machine torque, and compensates for the decrease in rotating machine torque with a brake torque of the brake 16.

As shown in FIG. 19, control is performed according to running curves independent of the load, so the rotating machine torque fluctuates depending on the load. However, the voltage command calculator 33*a* makes the brake torque effective in accordance with the amplitude of the fluctuation of the rotating machine torque, thereby making it possible to consequently compensate for a difference in the load with an amount of brake torque.

According to Embodiment 5 of the present invention, the speed sensor-less control means concomitantly uses brake torque in accordance with the moving direction and load of the car, thereby making it possible to achieve a reduction of low-speed regenerative torque. In addition, the speed sensor-less control means 30 is not required to change the running curves in accordance with the moving direction and load of the car as described in Embodiments 1 to 4 of the present invention in an interval in which brake torque takes effect. As a result, the speed sensor-less control means 30 can control the rotating machine stably and suppress retardation of the time for raising/lowering the elevator.

In the case where the compensation with brake torque through the brake 16 can be expected, the acceleration running curve itself stored in advance in the storage portion of the speed command signal generating means can be set such that a decrease in rotating machine torque is observed in the low-speed regenerative range.

The foregoing description has been given as to the case where the car 11 is raised. However, in the case where the car is lowered as well, it goes without saying that the changes in the running curves in at least one of the intervals D, E, and F as made in Embodiment 4 of the present invention can be made unnecessary through suitable combination of rotating machine torque and brake torque in the deceleration interval composed of the intervals D to F including the low-speed regenerative range.

Further, the aforementioned Embodiment 5 of the present invention has been described based on FIG. 17 showing the construction of Embodiment 4 of the present invention. However, the present invention is not limited thereto. In FIG. 1 showing the constructions of Embodiments 1 to 3 of the present invention, the voltage command calculator 33 may read the load of the car from the in-car load detector 12, thereby making it possible to realize the function described in Embodiment 5 of the present invention.

Moreover, the aforementioned Embodiment 5 of the present invention is described as to the case where a braking operation in the deceleration interval is used concomitantly with the acceleration running curve which is constant independent of the moving direction and load of the car. However, the present invention is not limited thereto. As described in Embodiments 1 to 4 of the present invention, in the case where the acceleration running curve corresponding to the moving direction and load of the car is used as well, the braking operation in the deceleration interval can be used concomitantly. As a result, the speed sensor-less control means can control the rotating machine stably and hence can suppress retardation of the time for raising/lowering the elevator.

A general-purpose inverter for driving a rotating machine can apply a voltage to the rotating machine (induction machine) such that a desired rotational speed is obtained in response to the input of a speed command. Therefore, the general-purpose inverter can be used as the aforementioned speed sensor-less control means 30.

EFFECT OF THE INVENTION

According to the present invention, the acceleration running curve in the deceleration interval is changed in accordance with the moving direction and load of the car, or the brake torque is used concomitantly. It is therefore possible to obtain the control device for the rotating machine of the elevator which makes it possible, without using a speed detector, to suppress an increase in the moving time of the elevator while securing control performance and stability in accordance with the moving direction and load of the car of the elevator.

What is claimed is:

1. A control device for controlling speed of a rotating machine driving an elevator without using a speed sensor, the control device comprising:

speed command signal generating means for generating a rotational speed command for the rotating machine; and speed sensor-less control means for controlling a voltage applied to the rotating machine without using the speed sensor, based on the rotational speed command issued from the speed command signal generating means, wherein the speed command signal generating means changes an acceleration running curve in a deceleration interval in accordance with a moving direction and a load of a car of the elevator to generate the rotational speed command.

2. The control device according to claim 1, wherein the speed command signal generating means changes the acceleration running curve to prolong a deceleration period and to reduce magnitude of jerk in the deceleration period as the load of the car decreases during raising of the car, and to prolong the deceleration period and to reduce the magnitude of jerk in the deceleration period as the load of the car increases during lowering of the car.

3. The control device according to claim 1, wherein the speed command signal generating means changes the acceleration running curve to prolong a deceleration period and to change with time magnitude of jerk in the deceleration period toward zero as the load of the car decreases during raising of the car, and to prolong the deceleration period and to change with time the magnitude of jerk in the deceleration period toward zero as the load of the car increases during lowering of the car.

4. The control device according to claim 1, wherein the speed command signal generating means changes the acceleration running curve to prolong a deceleration period and to cause changes in jerk with time such that magnitude of acceleration in the deceleration period decreases as the load of the car decreases during raising of the car, and to prolong the deceleration period and to cause changes in jerk with time such that the magnitude of acceleration in the deceleration period decreases as the load of the car increases during lowering of the car.

5. The control device according to claim 1, wherein the speed sensor-less control means comprises a current detector for detecting current value of the rotating machine, a voltage command calculator for generating a voltage command based on the rotational speed command from the speed command signal generating means and the current value detected by the current detector, and a pulse width modulation (PWM) inverter for applying a voltage based on the voltage command, the voltage command calculator, which has a storage portion in which data on torque command and load that are associated with each other are stored in advance, calculates a torque command required for causing rotational speed to follow the rotational speed command, acquires a load corresponding to a torque command in an acceleration interval of the elevator from the storage portion to estimate load of the car, and outputs the load of the car estimated to the speed command signal generating means, and the speed command signal generating means acquires the load of the car from the voltage command calculator.

6. The control device according to claim 1, wherein the control device further comprises a brake for applying a braking torque to the rotating machine, and the speed sensor-less control means makes the braking torque of the brake effective to compensate for a deficiency in regenerative torque in the deceleration interval in accordance with moving direction and load of the car.

7. A control device for controlling speed of a rotating machine driving an elevator without using a speed sensor, the control device comprising:

speed command signal generating means for generating a rotational speed command for the rotating machine;

speed sensor-less control means for controlling a voltage applied to the rotating machine without using a speed sensor, based on the rotational speed command from the speed command signal generating means; and a brake for applying a braking torque to the rotating machine, wherein the speed sensor-less control means makes the braking torque of the brake effective to compensate for a deficiency in regenerative torque in a deceleration interval in accordance with moving direction and load of a car of the elevator so that a constant acceleration running curve is obtained, regardless of the load of the car.

8. The control device according to claim 1, wherein the speed sensor-less control means comprises:

a current detector for detecting current value of the rotating machine;

a voltage command calculator for generating a voltage command based on the rotational speed command from the speed command signal generating means and the current value detected by the current detector; and a pulse width modulation (PWM) inverter for applying a voltage based on the voltage command, wherein the speed sensor-less control means estimates rotational speed of the rotating machine based on the current value detected and the voltage command.

9. A control device according to claim 8, wherein the speed command signal generating means changes the acceleration running curve to prolong a deceleration period and to reduce magnitude of jerk in the deceleration period as the load of the car decreases during raising of the car, and to prolong the deceleration period and to reduce the magnitude of jerk in the deceleration period as the load of the car increases during lowering of the car.

10. The control device according to claim 8, wherein the speed command signal generating means changes the acceleration running curve to prolong a deceleration period and to change with time magnitude of jerk in the deceleration period toward zero as the load of the car decreases during raising of the car, and to prolong the deceleration period and to change with time the magnitude of jerk in the deceleration period toward zero as the load of the car increases during lowering of the car.

11. The control device according to claim 8, wherein the speed command signal generating means changes the acceleration running curve to prolong a deceleration period and to cause changes in jerk with time such that magnitude of acceleration in the deceleration period decreases as the load of the car decreases during raising of the car, and to prolong the deceleration period and to cause changes in jerk with time such that the magnitude of acceleration in the deceleration period decreases as the load of the car increases during lowering of the car.

12. The control device according to claim 8, wherein the speed sensor-less control means comprises a current detector for detecting current value of the rotating machine, a voltage command calculator for generating a voltage command based on the rotational speed command from the speed command signal generating means and the current value detected by the current detector, and a pulse width modulation (PWM) inverter for applying a voltage based on the voltage command, the voltage command calculator, which has a storage portion in which data on torque command and load that are associated with each other are stored in advance, calculates a torque command required for causing rotational speed to follow the rotational speed command, acquires a load corresponding to a torque command in an acceleration interval of the elevator from the storage portion to estimate load of the car, and outputs the load of the car estimated to the speed command signal generating means, and the speed command signal generating means acquires the load of the car from the voltage command calculator.

13. The control device according to claim 8, wherein the control device further comprises a brake for applying a braking torque to the rotating machine, and the speed sensor-less control means makes the braking torque of the brake effective to compensate for a deficiency in regenerative torque in the deceleration interval in accordance with moving direction and load of the car.

* * * * *